US008328176B2

(12) United States Patent
Shimamura

(10) Patent No.: US 8,328,176 B2
(45) Date of Patent: Dec. 11, 2012

(54) PAPER SHEET STACKING DEVICE, AND BOOKBINDING DEVICE

(75) Inventor: Masashi Shimamura, Gunma (JP)

(73) Assignee: MAX Co., Ltd., Tokyo (JP)

( * ) Notice: Subject to any disclaimer, the term of this patent is extended or adjusted under 35 U.S.C. 154(b) by 948 days.

(21) Appl. No.: 12/440,200

(22) PCT Filed: Sep. 6, 2007

(86) PCT No.: PCT/JP2007/067424

§ 371 (c)(1),
(2), (4) Date: Mar. 5, 2009

(87) PCT Pub. No.: WO2008/029883

PCT Pub. Date: Mar. 13, 2008

(65) Prior Publication Data

US 2010/0195119 A1 Aug. 5, 2010

(30) Foreign Application Priority Data

Sep. 8, 2006 (JP) ..... 2006-244244

(51) Int. Cl.
*B65H 39/00* (2006.01)

(52) U.S. Cl. ..... 270/58.13; 270/58.08; 270/58.11; 270/58.28; 270/58.14; 270/58.15; 270/58.18; 270/58.19

(58) Field of Classification Search ..... 270/58.13, 270/58.08, 58.11, 58.12, 58.28, 58.14, 58.15, 270/58.07, 58.18, 58.19, 58.27, 58.16, 58.17; 271/213, 214, 215, 218
See application file for complete search history.

(56) References Cited

U.S. PATENT DOCUMENTS

| | | | | |
|---|---|---|---|---|
| 7,762,539 | B2 * | 7/2010 | Nagata et al. | 270/58.08 |
| 7,780,160 | B2 * | 8/2010 | Sato | 270/58.12 |
| 8,177,215 | B2 * | 5/2012 | Ohkawa | 270/58.11 |
| 2006/0202402 | A1 * | 9/2006 | Nagata et al. | 270/58.08 |
| 2008/0056792 | A1 * | 3/2008 | Sato | 399/408 |

FOREIGN PATENT DOCUMENTS

| | | | |
|---|---|---|---|
| JP | 2002-173262 | A | 6/2002 |
| JP | 2007-45605 | A | 2/2007 |

* cited by examiner

*Primary Examiner* — Leslie A Nicholson, III
(74) *Attorney, Agent, or Firm* — Chernoff Vilhauer McClung Stenzel LLP

(57) ABSTRACT

To provide a paper-sheet-loading device that makes it easy to take out booklet or the like loaded on a tray. The paper-sheet-loading device 1 is provided with a discharge-processing portion 7 which discharges the booklet or the like through a discharge portion and a discharged paper stacker 8 having a loading stage 80 on which the booklet or the like discharged from the discharge-processing portion 7 is loaded. The loading stage 80 is provided with a tray 81 on which the booklet or the like is loaded and which can be pulled out from the front side of the device and an auxiliary loading member **80*b* closing the lower side of a rear side of the tray 81 when the tray 81 is pulled out. The auxiliary loading member 80*b* has a shape after a loading face 81*a* of the tray 81 and becomes exposed continuously from the lower side of the tray 81** to the rear side thereof, thereby enabling the booklet or the like to be loaded without losing its balance.

4 Claims, 26 Drawing Sheets

PAPER SHEET STACKING DEVICE, AND BOOKBINDING DEVICE

CROSS-REFERENCE TO RELATED APPLICATONS

This is a national stage application filed under 35 USC 371 based on International Application No. PCT/JP2007/067424 filed Sep. 6, 2007, and claims priority under 35 USC 119 of Japanese Patent Application No. 2006-244244 filed Sep. 8, 2006.

TECHNICAL FIELD

The present invention relates to a paper-sheet-loading device that loads and stores a booklet produced by binding a bundle of paper sheets, an unbound bundle of paper sheets or the like and a book-binding apparatus equipped with this paper-sheet-loading device.

BACKGROUND ART

Conventionally, a paper-sheet-handling apparatus, which is referred to as a post-handling apparatus etc., that binds paper sheets carried from an image formation apparatus such as a copy machine by a binding part such as a staple, to produce a booklet has been proposed.

In such a paper sheet handling apparatus, a loading mechanism that discharges produced booklets to an externally exposed tray and loads them on the tray is provided (see, for example, FIG. 1 in Japanese Patent Application Publication No. 2003-231092).

A paper-sheet-loading device which has a stage that moves up and down inside the device and loads paper sheets or the like on the stage has been proposed (see, for example, FIG. 1 in Japanese Patent Application Publication No. 2006-036533).

According to this configuration in which the paper sheets or the like are loaded on the stage inside the device, the paper sheets or the like loaded on the stage have been taken out by opening a door on a front surface of the device.

DISCLOSURE OF THE INVENTION

The paper-sheet-loading device having a configuration to load paper sheets and the like on the stage inside the device can increase storage capacity thereof by configuring the stage so as to be able to go up and down, and is suitable for use as an apparatus that stores products having a large thickness for each piece thereof such as abound booklet.

However, there is a need to take out loaded booklets from the stage inside the device, and if the number of these booklets increases, there occurs a problem that they are not easily taken out.

To solve such a problem, the present invention is developed and has an object to provide a paper-sheet-loading device that makes it easy to take out booklets loaded on a tray and a book-binding apparatus equipped with this paper-sheet-loading device.

To solve the problem, a paper-sheet-loading device according to the present invention is characterized in that the device is provided with a tray that has a loading face on which a bound booklet or unbound paper sheets or the like are loaded, elevation means for moving up and down the tray along a direction in which the booklet or the paper sheets or the like are loaded, an outlet that has an opening along the elevation direction of the tray in a front side of a body of the device, a tray guide member that slidably supports the tray between a loading position where the booklet or paper sheets or the like are loaded and a take-out position where it is pulled out from the outlet and the loaded booklet or paper sheets or the like are taken out, and an auxiliary loading member that is exposed to a rear side of the tray pulled out to the take-out position and that has a shape after a shape of the loading face of the tray.

According to the paper-sheet-loading device of the present invention, the bound booklet or the unbound paper sheets or the like are loaded on the tray.

The booklet etc. loaded on the tray are taken out from the outlet in the front surface of the device by pulling out the tray from the loading position to the take-out position. If the tray is pulled out from the loading position to the take-out position, the auxiliary loading member is exposed from the lower part of the tray to prevent the booklets etc. from dropping from the tray.

A book-binding apparatus, which produces a booklet by binding a plurality of paper sheets with a binding part, according to the invention is characterized in that the apparatus is provided with binding means for binding one side of a bundle of the paper sheets by the binding part to produce the booklet, paper discharge means for discharging the booklet bound by the binding means or the unbound paper sheets or the like through a discharge portion, a tray having a loading face on which the booklet or the paper sheets or the like discharged through the discharge portion are loaded, elevation means for moving the tray up and down along a direction in which the booklet or the paper sheets or the like are loaded, an outlet that has an opening along the elevation direction of the tray in a front face of a body of the apparatus, a tray guide member that slidably supports the tray between a loading position where the booklet or paper sheets or the like are loaded and a take-out position where it is pulled out from the outlet and the loaded booklet or paper sheets or the like are taken out, and an auxiliary loading member that is exposed to a rear side of the tray pulled out to the take-out position and that has a shape after a shape of the loading face of the tray.

In the book-binding apparatus of the present invention, the binding means binds a bundle of paper sheets with a binding part to produce a booklet. The paper discharging means discharges a booklet bound by the binding means or unbound paper sheets or the like to the tray and load the booklet or the like on the tray.

The booklet or the like loaded on the tray is taken out from the outlet in the front surface of the apparatus by pulling the tray from the loading position to the take-out position. When the tray is pulled out from the loading position to the take-out position, the auxiliary loading member is exposed from the lower side of the tray to prevent the booklet or the like from dropping to the lower side of the tray.

In accordance with the paper-sheet-loading device of the present invention, it is possible to load the booklets or the like on the tray inside the device and to take out the booklet or the like loaded on the tray by pulling out the tray.

In accordance with the book-binding apparatus of the present invention, the above-mentioned paper-sheet-loading device is provided, so that it is possible to take out the booklet or the like from the front surface of the apparatus by pulling out the tray. This enables the booklet or the like to be easily taken out even if the number of the booklets to be loaded on the tray is many.

Further, when the tray is pulled out from the loading position to the take-out position, the auxiliary loading member appears at the rear part of the tray, so that the booklet or the like does not drop to the lower side of the tray, thereby preventing the booklet or the like from being damaged and preventing a fault from occurring.

BEST MODE FOR CARRYING OUT THE INVENTION

The following will describe embodiments of a paper-sheet-loading device and a book-binding apparatus according to the present invention with reference to the drawings.

<Configuration Examples of Paper-Sheet-Loading Device and Book-Binding Apparatus of Present Embodiments>

Figure 1:
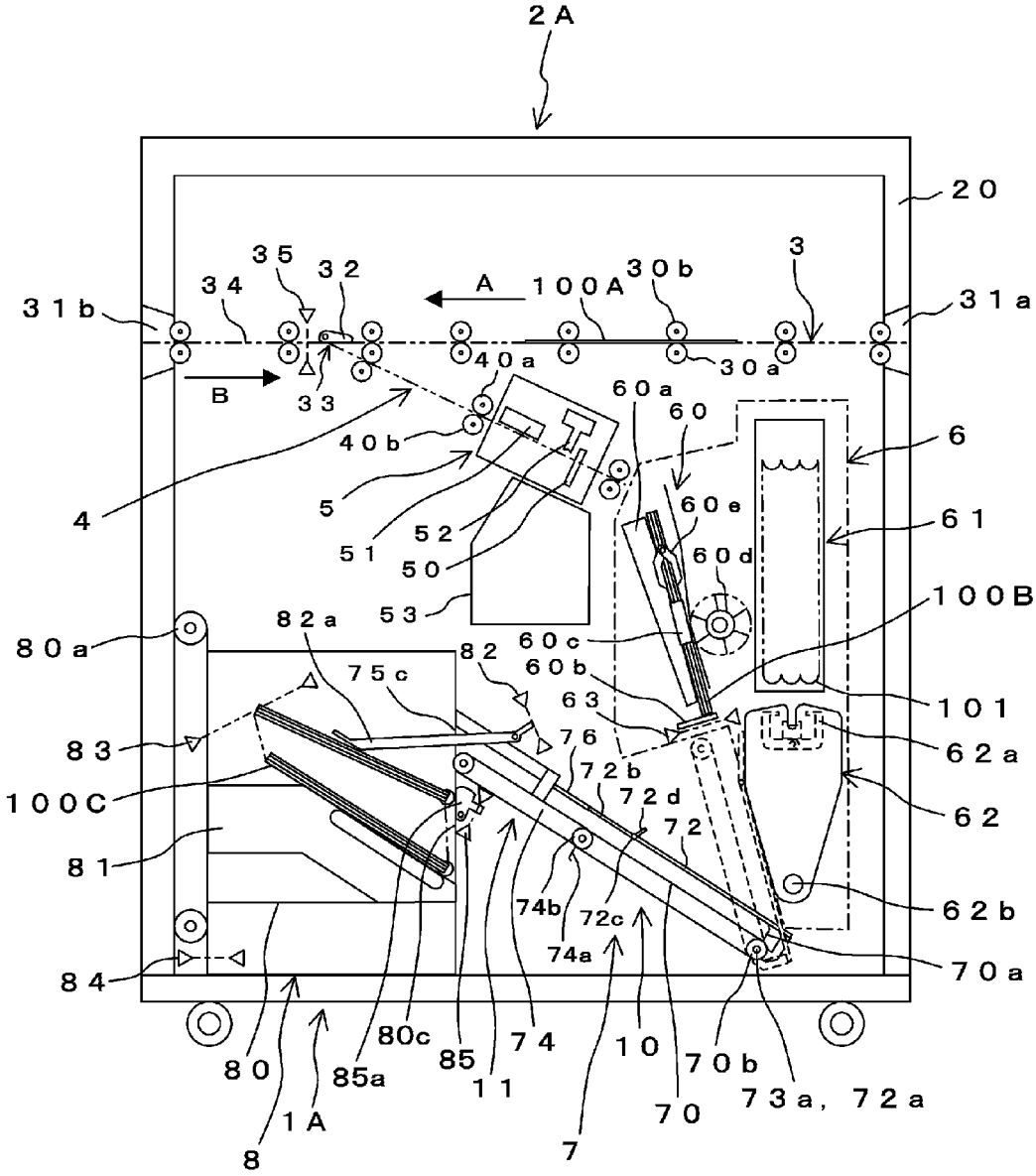
FIG. 1 is a configuration diagram showing an example of a book-binding apparatus equipped with a paper-sheet-loading device of the present embodiment.
Figure 2:
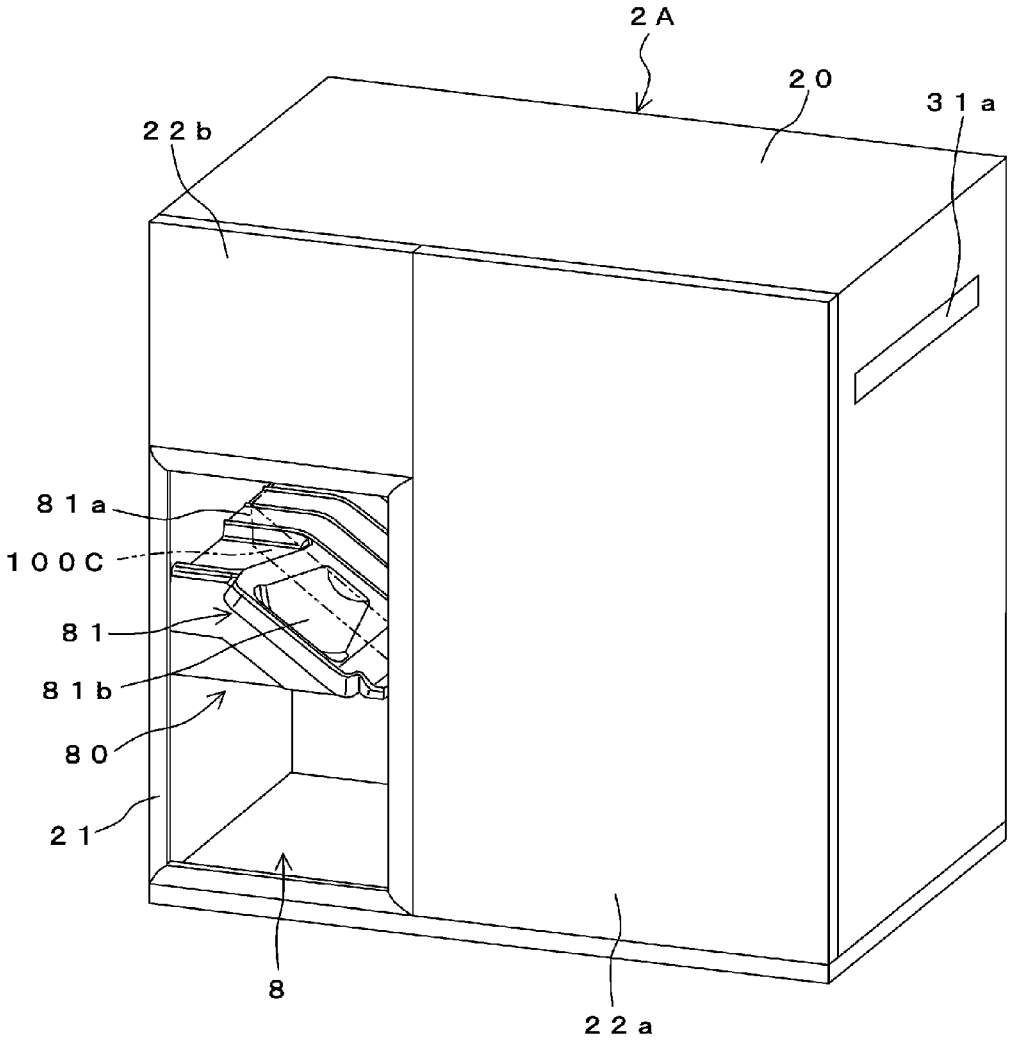
FIG. 2 is a configuration diagram showing the example of the book-binding apparatus equipped with the paper-sheet-loading device of the present embodiment.
Figure 3:
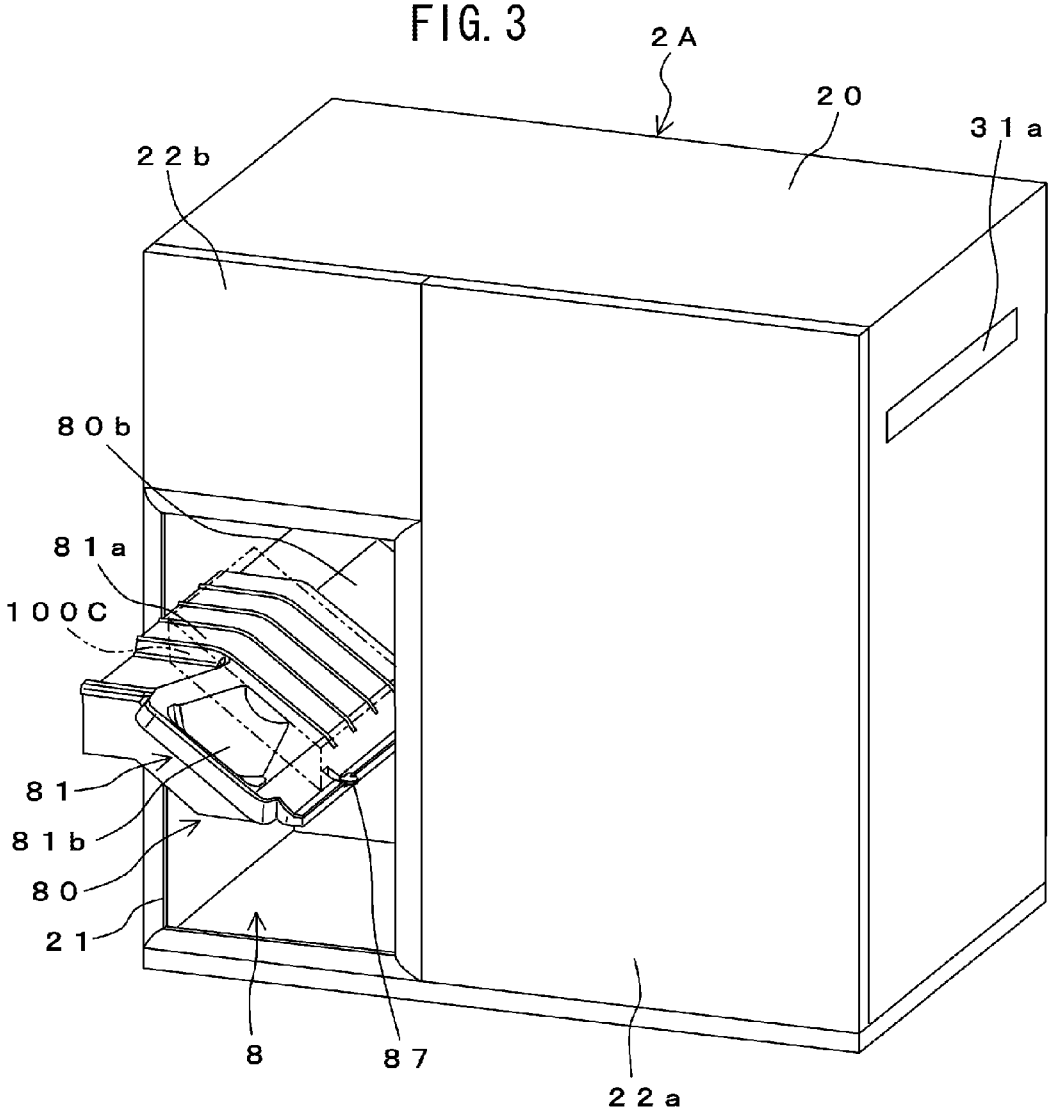
FIG. 3 is a configuration diagram showing the example of the book-binding apparatus equipped with the paper-sheet-loading device of the present embodiment.
Figure 4:
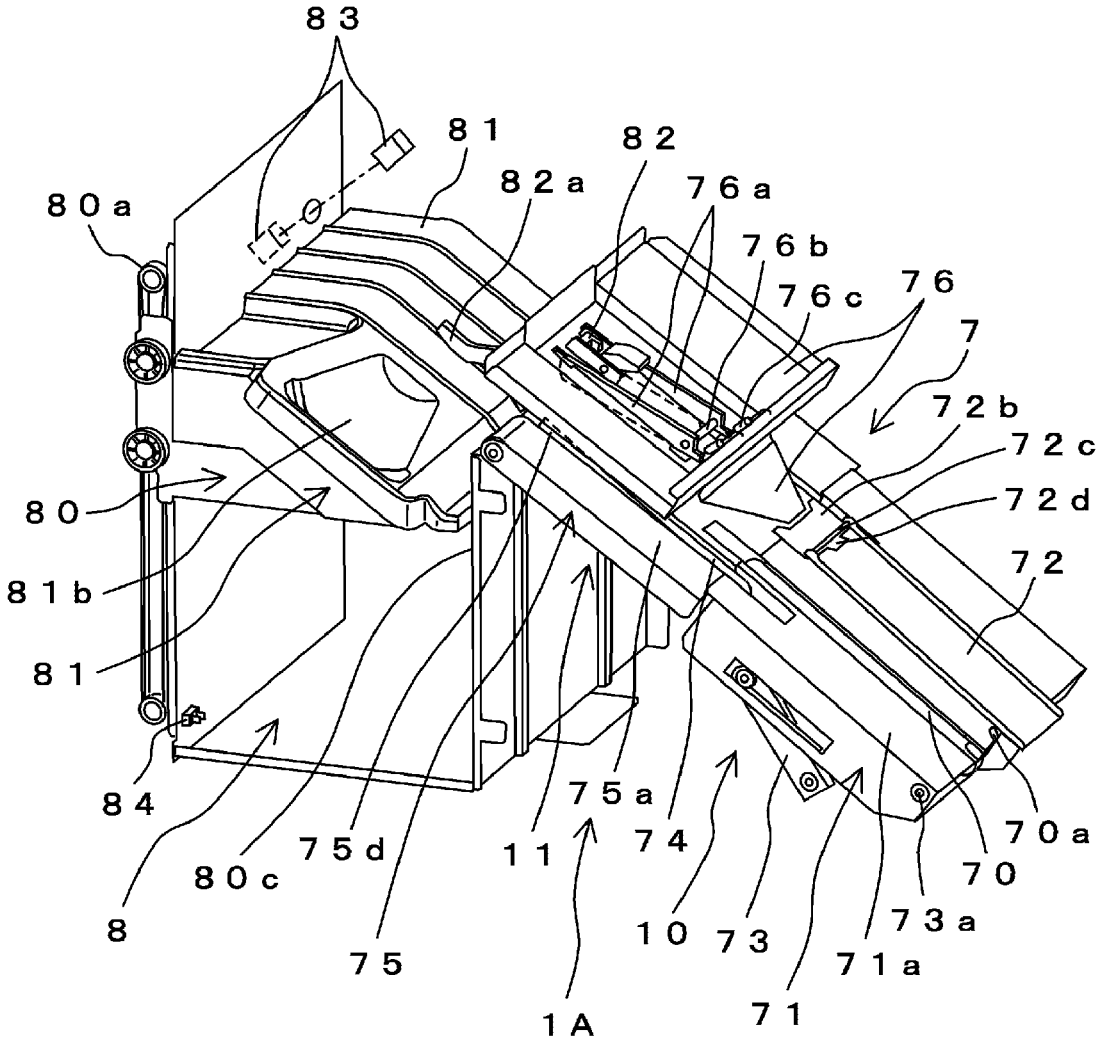
FIG. 4 is a configuration diagram showing an example of the paper-sheet-loading device of the present embodiment.
Figure 5:
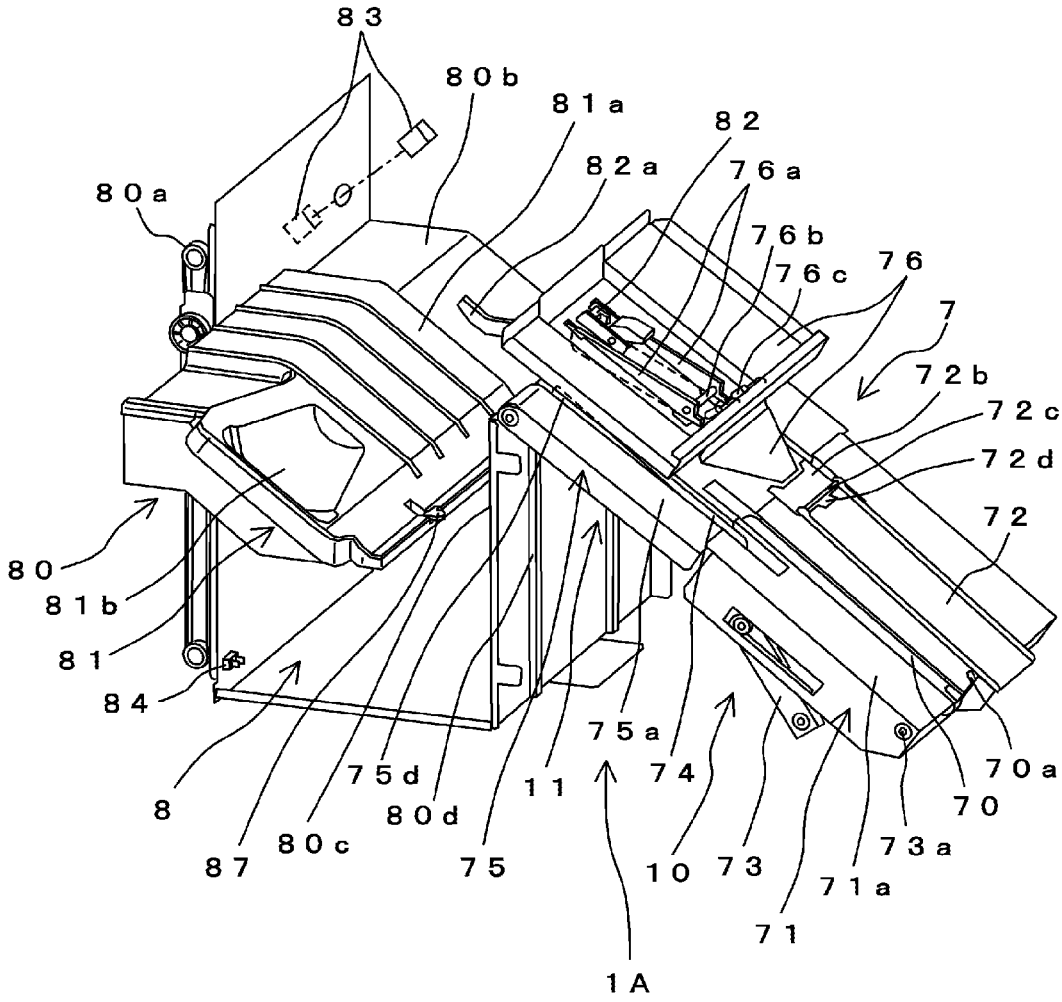
FIG. 5 is a configuration diagram showing the example of the paper-sheet-loading device of the present embodiment.

FIGS. 1, 2, and 3 are configuration diagrams showing an example of a book-binding apparatus equipped with a paper-sheet-loading device according to an embodiment of the present invention; in FIG. 1, an outline of the internal configuration of the book-binding apparatus is shown and in FIGS. 2 and 3, an external view of the book-binding apparatus is shown. FIGS. 4 and 5 are configuration diagrams showing an example of the paper-sheet-loading device of the present embodiment.

A paper-sheet-loading device 1A of the present embodiment is incorporated into, for example, a book-binding apparatus 2A, and loads booklets or the like produced by the book-binding apparatus 2A to store them.

The book-binding apparatus 2A, which is disposed, for example, between a copy machine and a post-handling apparatus, which are not shown, is provided with a first carriage path 3 that carries a paper sheet 100A, a second carriage path 4 which branches off from the first carriage path 3, a punch-processing portion 5 that punches the paper sheet 100A, a binder unit 6 that produces a booklet by binding a bundle of paper sheets 100B in which a plurality of punched paper sheets is aligned, a discharge-processing portion 7 that carries booklets or the like such as a bound booklet 100C or the bundle of unbound paper sheets 100B, and a discharged paper stacker 8 that stores the booklets or the like discharged by the discharge-processing portion 7.

The first carriage path 3 is disposed to the upper part inside the book-binding apparatus 2A and equipped with a plurality of feed rollers 30*a* which are driven rotationally, a plurality of guide rollers 30*b* which face the feed rollers 30*a*, and a guide member etc., not shown.

The book-binding apparatus 2A has a paper feed opening 31*a* which connects to the first carriage path 3 on one side surface of a frame 20 and a discharge opening 31*b* which connects to the first carriage path 3 on the other side surface of the frame 20 so that the first carriage path 3 configures a carriage path that is roughly horizontal linear path to carry paper sheets between the paper feed opening 31*a* and the discharge opening 31*b*.

On the downstream side in a carriage direction A directed from the paper feed opening 31*a* toward the discharge opening 31*b*, the first carriage path 3 is equipped with a switch blade 32 which switches the carriage direction, thereby forming a branch portion 33 between the first carriage path 3 and the second carriage path 4. Further, the first carriage path 3 forms a reversal suspending portion 34 between the discharge opening 31*b* and the branch portion 33 on the downstream side thereof.

The second carriage path 4 branches off downward from the first carriage path 3 at the branch portion 33 and is equipped with a plurality of feed rollers 40*a* which are driven rotationally, a plurality of guide rollers 40*b* which face the feed rollers 30*a*, and a guide member etc., not shown.

The second carriage path 4 branches off in a direction opposite to the carriage direction A along the first carriage path 3 and, communicates with the reversal suspending portion 34 by operation of the switch blade 32.

By being driven rotationally, the switch blade 32 moves between a position to which it retreats from the first carriage path 3 and a position at which it projects into the first carriage path 3.

If the switch blade 32 is set to the position to which it retreats from the first carriage path 3, the paper sheet 100A, being carried on the first carriage path 3 from the paper feed opening 31*a* along the carriage direction A, passes through the switch blade 32 up to the reversal suspending portion 34.

Conversely, if the switch blade 32 is set to the a position at which it projects into the first carriage path 3, the paper sheet 100A, being carried on the first carriage path 3 from the reversal suspending portion 34 along a carriage direction B with the carriage direction being reversed, is sent by the guide of the switch blade 32 up to the second carriage path 4 from the first carriage path 3.

In such a manner, the second carriage path 4 constitutes a carriage path in which a carriage direction of the paper sheet 100A carried on the first carriage path 3 from the paper feed opening 31*a* to the discharge opening 31*b* along the carriage direction A is reversed to the carriage direction B at the reversal suspending portion 34, thereby performing a switch-back thereon downward from the first carriage path 3.

The first carriage path 3 is equipped with a paper sheet detection sensor 35 at the reversal suspending portion 34. The paper sheet detection sensor 35 detects whether or not a rear end of the paper sheet 100A carried on the first carriage path 3 along the carriage direction A is carried up to a position where it passes the switch blade 32.

It is to be noted that in the first carriage path 3 and the second carriage path 4, the guide rollers are attached to the guide members, not shown, and by such a configuration that the guide members can be opened and closed, a paper sheet may be removed easily in the case of a paper jam.

The punch-processing portion 5 is disposed on the second carriage 4 and is provided with an butting shutter 50 which adjusts position of a carriage directional end of the paper sheet 100A, a biasing mechanism portion 51 which adjusts a position of the paper sheet 100A in the horizontal position thereof, punch blades 52 which punch the paper sheet 100A, and the like.

The butting shutter 50 has a configuration such that it moves between a position where it projects into the second carriage path 4 so that the paper sheet 100A fed to the punch-processing portion 5 is butted against it and a position where it retreat from the second carriage path 4 so that the paper sheet 100A can pass through, thereby opening and closing the punch-processing portion 5. When the butting shutter 50 projects into the second carriage path 4, the end of the paper sheet 100A carried on the second carriage path 4 butts against it so that the end of the paper sheet 100A is regulated to a predetermined position.

The biasing mechanism portion 51 is equipped with a biasing guide on one of right side and left side with respect to the carriage direction of the paper sheet 100A and a reference guide on the other side, and has a configuration such that the biasing guide moves closer to and away from the reference guide so as to butt the paper sheet 100A fed to the punch-processing portion 5 against the reference guide.

The punch blades 52 are configured to reciprocate in a direction perpendicular to a face of the paper sheet 100A carried on the second carriage path 4, by which the position of the paper sheet 100A is adjusted by the butting shutter 50 and the biasing mechanism portion 51 and by reciprocating the punch blades 52, predetermined holes are punched in the paper sheets 100A.

It is to be noted that a punch-chip stacker 53 is mounted at the lower part of the punch-processing portion 5 in order to recover punch chips generated by punching the paper sheets 100A by the punch blades 52.

The binder unit 6, which is one example of binding means, is disposed on the downstream side of the punch-processing portion 5 and is provided with a paper alignment portion 60 which aligns and deposits a plurality of paper sheets, each of which is punched by the punch-processing portion 5, a binding part stacker 61 which stores a binding part 101 which binds the paper sheets, and a binding portion 62 which binds with the binding part 101 the bundle of paper sheets 100B aligned and deposited by the paper alignment portion 60.

The paper alignment portion 60 is provided with an butting shutter 60*b* which aligns the carriage directional ends of paper sheets at a paper-sheet temporary reserve portion 60*a*, a biasing mechanism portion 60*c* which aligns the paper sheets in the horizontal position thereof, a paddle mechanism portion 60*d* which causes the paper sheets to be butted against the butting shutter 60*b*, and a clamp mechanism portion 60*e* which holds a booklet or the like such as the bundle of paper sheets 100B or the booklet 100C.

The butting shutter 60*b* has a configuration such that it moves between a position where it projects into the temporary reserve portion 60*a* so that the paper sheets fed to the paper alignment portion 60 butt against it and a position where it retreat from the temporary reserve portion 60*a* so that the booklet or the like can pass through, thereby opening and closing the temporary reserve portion 60*a*.

The biasing mechanism portion 60*c* is provided with a biasing guide on one of right side and left side with respect to the carriage direction of paper sheets and a reference guide on the other side, and has a configuration such that the biasing guide moves closer to and away from the reference guide so as to butt the paper sheets fed to the binder unit 6 against the reference guide.

The paddle mechanism portion 60*d* is equipped with a paddle roller whose plurality of tongue strips are disposed in the circumferential direction and which is driven rotationally and has a configuration that paper sheets fed to the paper sheet alignment portion 60 are caught by it and caused to be butted against the butting shutter 60*b* projected into the temporary reserve portion 60*a*. It is to be noted that a rotary shaft of the paddle roller is inclined in a guiding direction on the side where the biasing mechanism portion 60*c* is fixed, so that the paddle roller gives to the paper sheets fed to the paper sheet alignment portion 60 a force causing them to be butted to a direction of a guide of the biasing mechanism portion 60*c* at a fixed side thereof.

The clamp mechanism portion 60*e* has a configuration which catches and holds the bundle of paper sheets 100B fed to the paper sheet alignment portion 60 and aligned by the butting shutter 60*b*, the biasing mechanism portion 60*c*, and the paddle mechanism 60*d* and also moves the held bundle of paper sheets 100B to a predetermined process position.

A binding part stacker 61, which stores a vertical stack of a plurality of the binding parts 101 and has an outlet for taking out the binding parts 101 in its lower part thereof, has a configuration so as to take out the binding parts 101 one by one in cooperation with a binding portion 62. Each of the binding parts 101 has a configuration to have, for example, a plurality of ring formation members as many as the number of holes punched in the paper sheet 100A and a rear portion that interconnects the ring formation members.

The binding portion 62 is equipped with a binding mechanism portion 62*a* or the like which takes out the binding parts 101 stored in the binding part stacker 61 to bind and, swings around a rotational pivot 62*b* with it being driven rotationally, so that the binding mechanism portion 62*a* moves between a binding part take-out position where faces the binding part stacker 61 and a paper sheet binding position where it faces the paper alignment portion 60.

The binding mechanism portion 62*a* has a configuration to take out the binding parts 101 from the binding part stacker 61 at the position to face the binding part stacker 61 and hold them and to bind the bundle of paper sheets 100B aligned and held by the paper alignment portion 60 by using the binding part 101 at the position to face the paper sheet alignment portion 60.

The binder unit 6 is equipped with a paper sheet detection sensor 63 on a carriage path from the paper alignment portion 60 to the discharge-processing portion 7. The paper sheet detection sensor 63 detects whether or not the booklet or the like such as a booklet 100C aligned by the paper alignment portion 60 and bound with the binding part 101 or the unbound bundle of paper sheets 100B aligned by the paper alignment portion 60 is transferred to the discharge-processing portion 7.

The discharge-processing portion 7, which is one of paper discharge means, is disposed on a downstream side of the binder unit 6, to receive the booklet or the like from the binder unit 6 and reverse the carriage direction thereof, thus discharging it to the discharged paper stacker 8.

The discharge-processing portion 7 is provided with a first discharged paper carriage path 10 to receive the booklet or the like and switch and reverse the carriage direction thereof, a second paper sheet carriage path 11 to receive the booklet or the like from the first discharged paper carriage path 10 and discharge it to the discharged paper stacker 8, and the like.

The first discharged paper carriage path 10 is provided with a belt conveyance mechanism 70 to carry the booklet or the like, a main guide member 71 and an accessory guide member 72 to guide the carriage of the booklet or the like, and the like.

The belt conveyance mechanism 70 is configured so that an endless conveyor belt having a catcher 70*a* mounted thereon is stretched over a pair of pulleys driven rotationally.

The main guide member 71 is equipped with the belt conveyance mechanism 70 on a back side of a guide face 71*a* for guiding the booklet or the like. The belt conveyance mechanism 70 extends along the carriage direction of the booklet or the like guided on the guide face 71*a*; in the present example, each of the two belt conveyance mechanisms 70 are mounted on the right and left sides with respect to the carriage direction.

The catcher 70*a* of the belt conveyance mechanism 70 has a shape so as to support the end surface side of the booklet or the like guided on the guide face 71*a* of the main guide member 71. If the belt conveyance mechanism 70 is driven rotationally in a predetermined direction, the catcher 70*a* projects out from the guide face 71*a* and move in the carriage direction along the guide face 71*a*.

The main guide member 71, at lower end side thereof that is an end side along the carriage direction of the booklet or the like, is axially supported via a first rotational pivot 73*a* on a frame body attached to the frame 20.

As the main guide member 71 having the belt conveyance mechanism 70 is driven rotationally by a carriage path movement mechanism 73, the first discharged paper carriage path 10 swings around the first rotational pivot 73*a* as a axis thereof, to move between a paper sheet reception position, indicated by a broken line in FIG. 1, which forms a carriage path from the binder unit 6 and a paper sheet discharge position, indicated by a solid line in FIG. 1, which forms a carriage path leading to the second discharged paper carriage path 11.

Here, in the present example, the first rotational pivot 73*a* that serves as the swing axis of the main guide member 71 and the rotary axis of one pulley 70*b* of the belt conveyance mechanism 70 are aligned on the same axis so that a driving force can be transmitted through a simple configuration to the belt conveyance mechanism 70, which swings together with the main guide member 71.

The accessory guide member 72 extends along a carriage direction of the booklet or the like guided by the main guide member 71 and at a lower end thereof that is an end side along the carriage direction of the booklet or the like, is axially supported on the main guide member 71 via the second rotational pivot 72*a*.

The accessory guide member 72 is urged toward a direction of the main guide member 71 around a second rotational pivot 72*a* owing to an urging means (not shown) such as a spring, thereby facing the guide face 71*a* of the main guide member 71 roughly in parallel with predetermined spacing preserved therebetween so as to pass the booklet or the like there.

Then, the accessory guide member 72 moves from the paper sheet reception position to the paper sheet discharge position in conjunction with an operation in which the main guide member 71 swings around the first rotational pivot 73*a* as the axis thereof to move from the paper sheet reception position to the paper sheet discharge position. However, if a load resisting against the movement toward the paper sheet discharge position is applied to the accessory guide member 72, the accessory guide member 72 swings around the second rotational pivot 72*a* as axis thereof, thus retreating from the main guide member 71.

In this case, in the present example, the second rotational pivot 72*a* that serves as the swing axis of the accessory guide member 72 and the rotary axis of one pulley 70*b* of the belt conveyance mechanism 70 are aligned on the same axis.

The accessory guide member 72 is equipped with a delivery guide 72*b* at its upper end, which is the other end side along the carriage direction of the booklet or the like. The delivery guide 72*b* is axially supported on the accessory guide member 72 via a rotational pivot 72*c*, so that by swinging around the rotational pivot 72*c* as an axis thereof, the tip side of the accessory guide member 72 is opened and closed with respect to the main guide member 71.

The delivery guide 72*b* is urged toward a direction of the main guide member 71 by an urging means (not shown) such as a spring, thereby facing the guide face 71*a* of the main guide member 71 roughly in parallel with predetermined spacing preserved therebetween so as to pass the booklet or the like there.

The delivery guide 72*b* has a butting strip 72*d* formed on its end on a side of the rotational pivot 72*c*. The accessory guide member 72 is configured so that when the first discharged paper carriage path 10 swings around the first rotational pivot 73*a* as an axis thereof to move to the paper sheet reception position together with the main guide member 71, the butting strip 72*d* is butted against a butting portion (not shown) formed on the binder unit 6.

when the butting strip 72*d* is pressed due to the movement of the first discharged paper carriage path 10 to the paper sheet reception position, the delivery guide 72*b* swings around the rotational pivot 72*c* as an axis thereof so that its tip side opens with respect to the main guide member 71.

Accordingly, when the first discharged paper carriage path 10 moves to the paper sheet reception position, the tip side that serves as a delivery portion for the binder unit 6 opens with respect to the main guide member 71, so that the accessory guide member 72 serves as a guide for delivery from the binder unit 6.

Conversely, when the first discharged paper carriage path 10 moves to the paper sheet discharge position, the butting strip 72*d* separates from the butting portion (not shown), so that the accessory guide member 72 faces the guide face 71*a* of the main guide member 71 roughly in parallel, thus serving as a guide for carriage between itself and the second discharged paper carriage path 11.

The second discharged paper carriage path 11 is equipped with a belt conveyance mechanism 74 which carries the booklet or the like, a main guide member 75 and an accessory guide member 76, which guide carriage of the booklet or the like.

The belt conveyance mechanism 74 is configured so that an endless conveyor belt having a catcher 74*a* mounted thereon is stretched over a pair of pulleys driven rotationally.

The main guide member 75 is fixed to the frame body and is equipped with the belt conveyance mechanism 74 on the back side of a guide face 75*a* for guiding the booklet or the like. The belt conveyance mechanism 74 extends along the carriage direction of the booklet or the like guided on the guide face 75*a*; in the present example, the two belt conveyance mechanisms 74 are mounted on the right and left sides with respect to the carriage direction.

The catcher 74*a* of the belt conveyance mechanism 74 has a shape so as to support the end surface side of the booklet or the like guided on the guide face 75*a* of the main guide member 75. When the belt conveyance mechanism 74 is driven rotationally in a predetermined direction, the catcher 74*a* projects from the guide face 75*a* and moves in the carriage direction along the guide face 75*a*.

Here, since the pulley 74*b* on a side of the first discharged paper carriage path 10 extends into the first discharged paper carriage path 10, the belt conveyance mechanism 74 delivers the booklet or the like between the second discharged paper carriage path 11 and the first discharged paper carriage path 10 moved to the paper sheet discharge position.

The accessory guide member 76 is fixed to the frame 20 and the frame body, to face the guide face 75*a* of the main guide member 75 roughly in parallel with predetermined spacing preserved therebetween so as to pass the booklet or the like there.

Figure 6A:
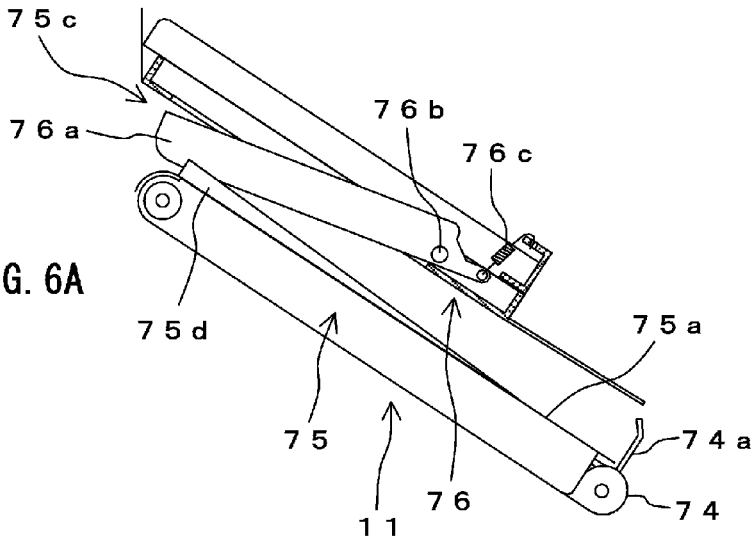
FIG. 6A is a partially exploded side view showing an example of a discharge portion of the paper-sheet-loading device of the present embodiment.
Figure 6B:
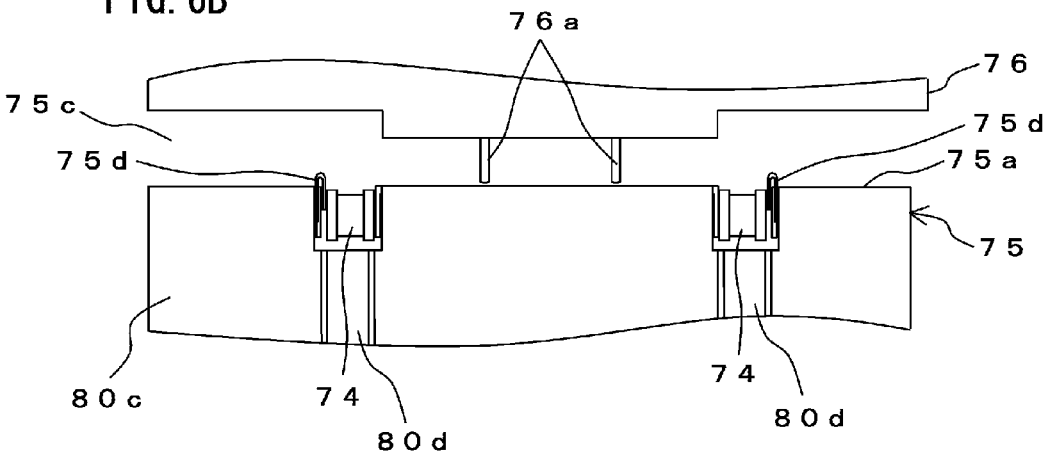
FIG. 6B is a front view showing the example of the discharge portion of the paper-sheet-loading device of the present embodiment.

FIGS. 6A and 6B show an example of the discharge portion of the paper-sheet-loading device according to the present embodiment; FIG. 6A is a partially exploded side view of a discharge portion 75*c* and FIG. 6B is a front view of the discharge portion 75*c*.

The main guide member 75 is equipped with lower side stiffening members 75*d*, which projects from the guide face 75*a* to its discharge portion 75*c*. The lower side stiffening member 75*d* is a convex shape member which extends along the carriage direction of the booklet or the like and is inclined in such a direction that an amount of its projection is more increased in proportion to an approach to a side of the discharge portion 75*c*. Further, the lower side stiffening member 75*d* is fixed to the main guide member 75 and, in the present example, is disposed outside each of the right and left belt carriage mechanisms 74.

The accessory guide member 76 is equipped with upper side stiffening members 76*a* on the discharge portion 75*c*. In the present example, the upper side stiffening member 76*a* is disposed near the center of booklet or the like carried between the main guide member 75 and the accessory guide member 76 inside each of the right and left lower side stiffening members 75*d*. The upper side stiffening member 76*a* extends along the carriage direction of the booklet or the like and its end on the opposite side of the discharge portion 75*c* is axially supported on the accessory guide member 76 via a rotational pivot 76*b*.

The upper side stiffening member 76*a* is urged toward a direction of the main guide member 75 owing to a spring 76*c* and inclined in such a direction that an amount of its projection is more increased in proportion to an approach to a side of the discharge portion 75*c* to project out from the accessory guide member 76. Thus, as the booklet or the like is carried between the main guide member 75 and the accessory guide member 76, the upper side stiffening members 76*a* are raised by the booklet or the like and swings around the rotational pivot 76*b*, thereby changing the amount of the projection in accordance with the thickness of the booklet or the like.

Referring back to FIGS. 1 to 5, the discharged paper stacker 8 is one example of the paper-sheet-loading device, is disposed on the downstream side of the discharge-processing portion 7, and is provided with a loading stage 80 on which the booklet or the like such as the bound booklet 100C or an unbound bundle of paper sheets, which are discharged through the discharge portion 75*c*, is loaded and a stage elevation mechanism 80*a* which moves up and down the loading stage 80.

The loading stage 80 is provided with a tray 81 mounted so that it can be pulled out from the front side of the apparatus to the near side, and on the tray 81, the booklet or the like such as the bound booklet 100C or the unbound bundle of paper sheets 100B are loaded. The stage elevation mechanism 80*a* is one example of elevation means and is provided with a belt etc. which is driven rotationally, thereby moving the loading stage 80 up and down so that the height of the tray 81 can be changed in accordance with the number of the booklets or the like to be loaded.

Figure 7:
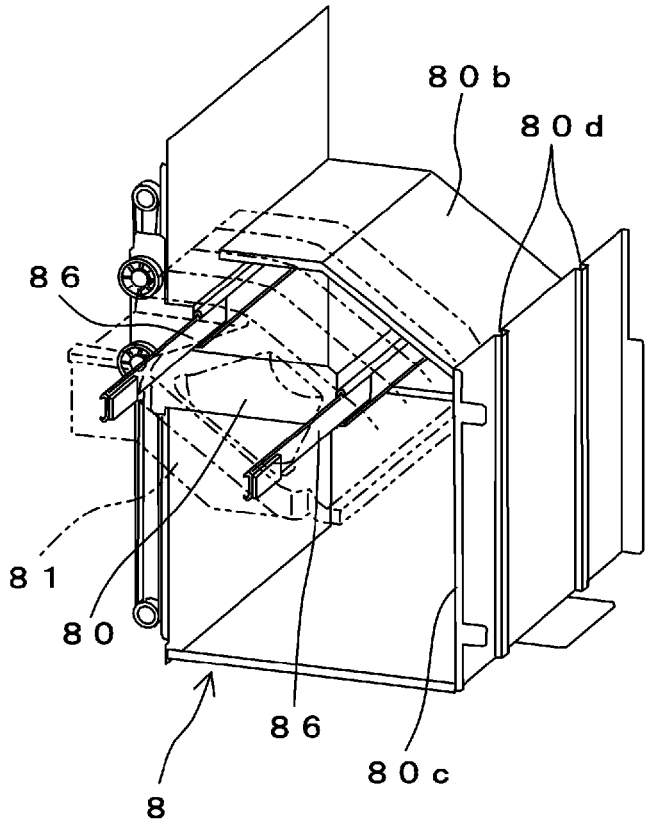
FIG. 7 is a configuration diagram showing an example of a tray pull-out mechanism.
Figure 8:
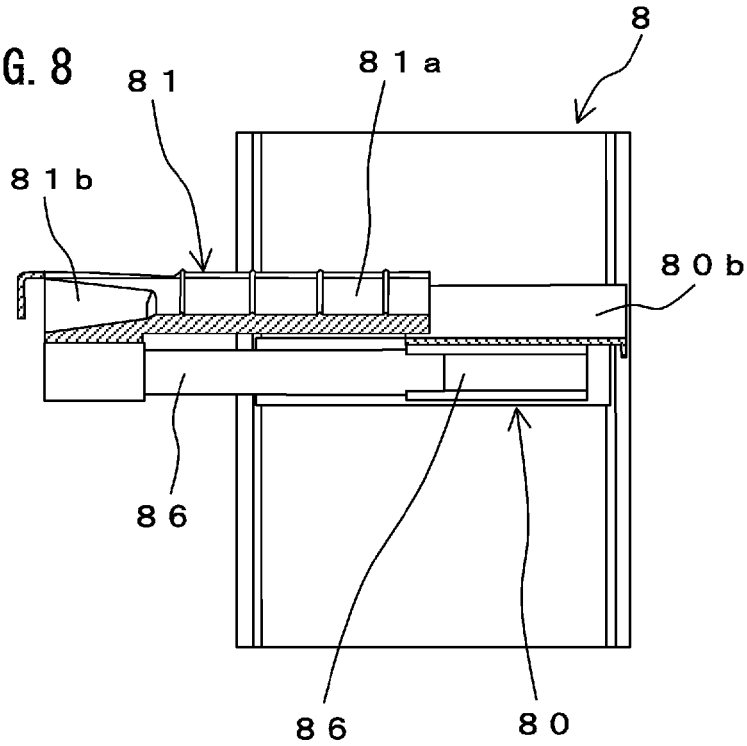
FIG. 8 is a configuration diagram showing the example of the tray pull-out mechanism.

FIGS. 7 and 8 are configuration diagrams showing an example of a pull-out mechanism of the tray 81; FIG. 7 is a perspective view of the main components of the discharged paper stacker 8 and FIG. 8 is a partially exploded side view of the discharged paper stacker 8.

The tray 81 is mounted on the loading stage 80 by way of, for example, two slide rails 86. The slide rails 86 are an example of a tray guide member; in the present example, two of the rails are combined so as to be configured to be telescopic.

Accordingly, the tray 81 is supported slidably between the loading position shown in FIGS. 2 and 4 on which the booklet or the like discharged through the discharge portion 75*c* is loaded and the take-out position shown in FIGS. 3 and 5 from which the loaded booklet or the like is taken out.

It is to be noted that although not shown, a stopper regulating a distance by which the tray 81 is pulled out is fitted to the slide rails 86, thereby preventing the tray 81 derailing from the slide rails 86 by the pulling-out operation of the tray 81.

Referring back to FIGS. 1 to 5, the tray 81 has a loading face 81*a* on which the booklet or the like is loaded. The loading face 81*a* has a slope face inclined in such a direction that a side thereof on which one side, which is bound with the binding part 101, of each of the booklets 100C is loaded goes down if the booklets 100C bounded by the binding part 101 are loaded so that a space in which the thicker side of each of the booklets 100C is loaded becomes broader, thereby enabling the more booklets 100C to be loaded.

Further, the tray 81 has a handle portion 81*b* at the near side in a pull-out direction thereof. The handle portion 81*b* has such a shape that the operator etc. can access it by his hand in a condition where the booklet or the like is loaded on the loading face 81*a*, so that the tray 81 is pulled out to the take-out position by holding the handle portion 81*b* and pulling it toward the near side. Conversely, by holding the handle portion 81*b* and pushing it to the interior, the tray 81 is returned to the loading position.

The loading stage 80 is provided with an auxiliary loading member 80*b* below the tray 81. The auxiliary loading member 80*b* has a shape after the loading face 81*a* of the tray 81 and, when the tray 81 is pulled out from the loading position to the take-out position, is exposed continuously from the lower side of the tray 81 to the interior, thereby closing a lower space in the rear direction of the tray 81.

Figure 9:
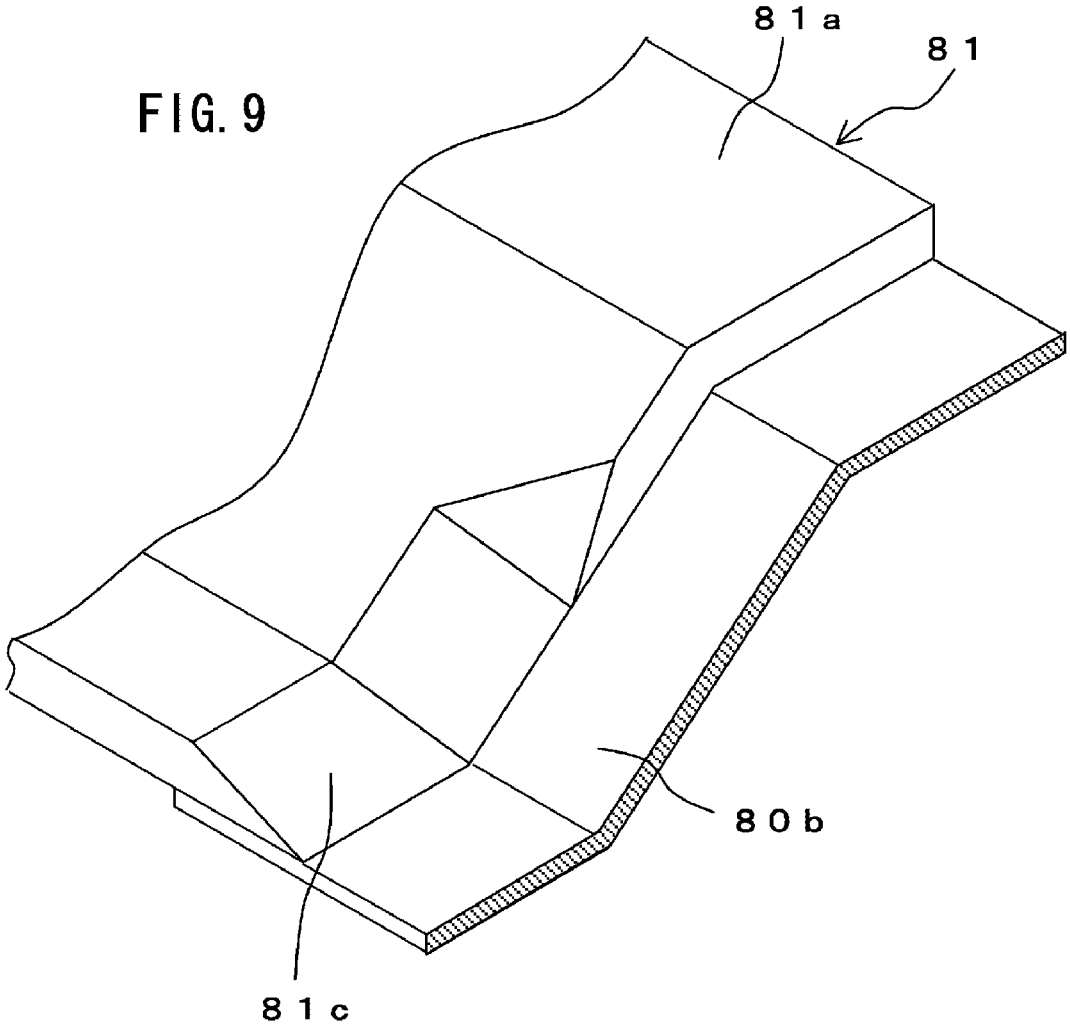
FIG. 9 is a configuration diagram showing an example of a guiding portion.

The tray 81 has a guiding portion 81*c* at its tip side in the push-in direction. FIG. 9 is a perspective view of the main components of the tray 81 for showing an example of the guiding portion 81*c*. The guiding portion 81*c* has a slope face, from the loading face 81*a*, inclined in such a direction as to go down toward the end in a push-in direction of the tray 81.

Accordingly, when the tray 81 is pulled out to the take-out position and the booklet or the like is placed on the auxiliary loading member 80*b*, by the operation that the tray 81 is returned from the take-out position to the loading position, the booklet or the like on the auxiliary loading member 80*b* run onto the guiding portion 81*c* and is loaded onto the tray 81.

Figure 10A:
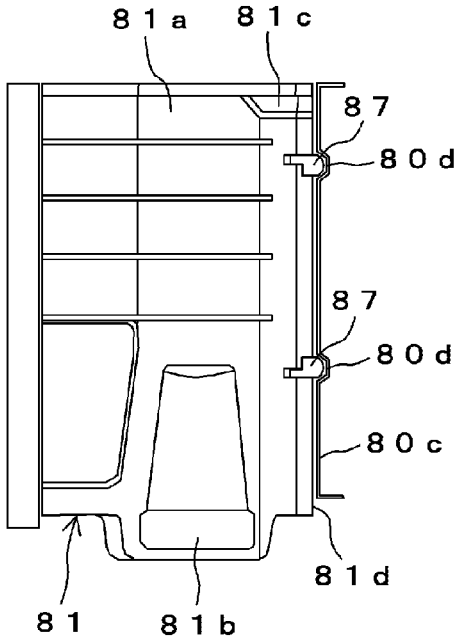
FIG. 10A is an overall plan view of a discharged paper stacker in a condition where the tray is located at a loading position for showing an example of a fall prevention member.
Figure 10B:
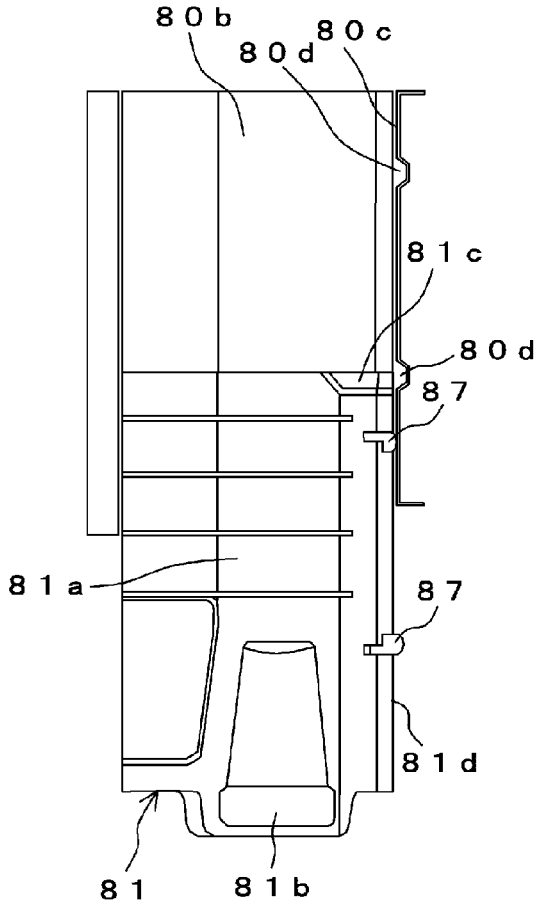
FIG. 10B is an overall plan view of the discharged paper stacker in a condition where the tray is located at a take-out position for showing the example of the fall prevention member.
Figure 11A:
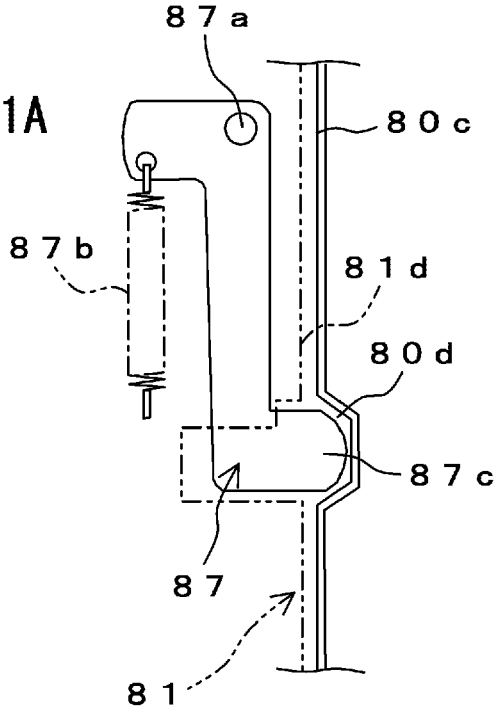
FIG. 11A is a plan view of a main portion of the discharged paper stacker in a condition where the tray is located at the loading position for showing the example of the fall prevention member.
Figure 11B:
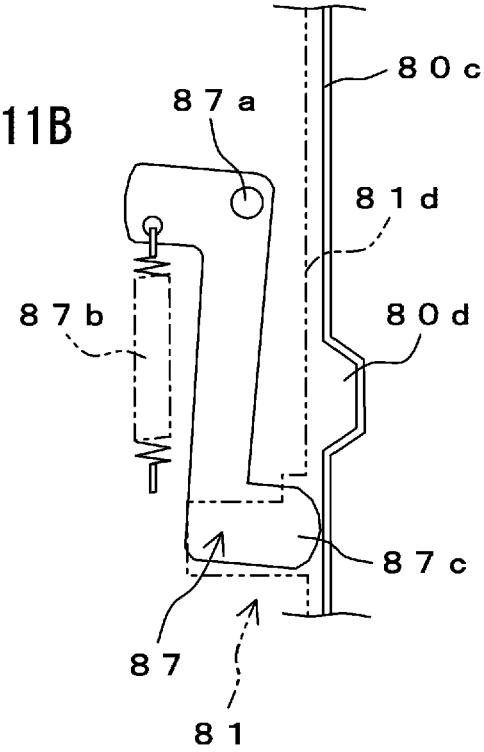
FIG. 11B is a plan view of the main portion of the discharged paper stacker in a condition where the tray is located at the take-out position for showing the example of the fall prevention member.

The tray 81 is provided with fall prevention members 87 on a lower end side thereof along the slope of the loading face 81*a*. FIG. 10A is an overall plan view of the discharged paper stacker 8 in a condition where the tray 81 is located at the loading position for showing an example of the fall prevention members 87 and FIG. 10B is an overall plan view of the discharged paper stacker 8 in a condition where the tray 81 is located at the take-out position for showing the example of the fall prevention members 87. Further, FIG. 11A is a plan view of a main portion of the discharged paper stacker 8 in a condition where the tray 81 is located at the loading position for showing the example of the fall prevention member 87 and FIG. 11B is a plan view of the main portion of the discharged paper stacker 8 in a condition where the tray 81 is located at the take-out position for showing the example of the fall prevention member 87.

The fall prevention member 87 is attached to the tray 81 in such a manner that it can swing around a support 87*a* as an axis thereof, so that by receiving a force pulled by a spring 87*b* which configures urging means, its projection portion 87*c* projects from an end face 81*d* of the tray 81. Further, by applying a force pushing the projection portion 87*c*, the projection portion 87*c* swings around the support 87*a* as an axis thereof against the spring 87*b*, thus being pushed in. Here, in the present example, the fall prevention members 87 are mounted to two positions in an interior direction of the tray 81.

The discharged paper stacker 8 is provided with a loading guide face 80*c* formed along a direction in which the tray 81 moves up and down, on the lower side thereof along the slope of the tray 81. The loading guide face 80*c* regulates the position of the booklet or the like on the tray 81 in such a manner that one side of the booklet or the like which is loaded obliquely on the loading face 81*a* along the slope of the tray 81 and is slid toward the loading guide face 80*c* butts against the loading guide face 80*c*. Further, the loading guide face 80*c* functions as a guide when the tray 81 moves up and down.

The loading guide face 80*c* is provided with guide grooves 80*d* formed along the direction in which the tray 81 moves up and down. As shown in FIG. 10A, in the present example, the guide grooves 80*d* are formed at two places aligned with positions of the fall prevention members 87 of the tray 81 located at the loading position so that the projection portion 87*c* projecting from the end face 81*d* of the tray 81 enter thereinto.

Accordingly, when the tray 81 is placed at the loading position, a part of gap between the end face 81*d* of the tray 81 and the loading guide face 80*c* is blocked by the fall prevention members 87, thereby preventing the booklet or the like loaded on the tray 81 from dropping through the gap.

Further, the projection portion 87*c* of each of the fall prevention members 87 and each of the guide grooves 80*d* in the loading guide face 80*c* have shapes so that when the projection portion 87*c* butts against the guide groove 80*d* by the operation such that the tray 81 is pulled out from the loading position, the projection portion 87*c* is pushed out. Accordingly, by the operation such that the tray 81 is pulled out from the loading position, the fall prevention member 87 retreats so as to have a configuration not to interfere with the pull-out operation of the tray 81.

Furthermore, the loading guide face 80*c* has a shape so as to press the projection portions 87*c* when the projection portions 87*c* butt against it by the operation such that the tray 81 is pushed in from the take-out position. Accordingly, by the operation such that the tray 81 is pushed in from the take-out position, the fall prevention member 87 retreats so as to have a configuration not to interfere with the push-in operation of the tray 81.

Then, when the fall prevention members 87 are located at such a position as to face the loading guide face 80*c*, the fall prevention members 87 are urged by the spring 87*b* in a projecting direction thereof, so that, by operations such that the tray 81 is pulled out from the loading position or pushed in from the take-out position, the projection portions 87*c* and the loading guide face 80*c* come in sliding contact with each other, thereby preventing the booklet or the like from dropping through the gap between the tray 81 and the loading guide face 80*c*.

The discharged paper stacker 8 is equipped with a tray height detection sensor 82, a loading top face attitude sensor 83, a lower limit tray position detection sensor 84 and a loaded position detection sensor 85.

In the present example, the tray height detection sensor 82 is configured of a pair of optical sensors whose optical axis are blocked by a height detection lever 82*a* which extends over the loading stage 80 and swings.

The tray height detection sensor 82 detects an upper limit position of the tray 81 or the booklet or the like loaded on the tray 81 based on existence or nonexistence of the height detection lever 82*a* raised by the tray 81 or the booklet or the like loaded on the tray 81 when the loading stage 80 moves up.

In the present example, the loading top face attitude sensor 83 is configured of a pair of optical sensors whose optical axis is blocked by the booklet or the like loaded on the tray 81, and a loading condition of the booklet or the like on the tray 81 is detected based on an output from the tray height detection sensor 82 when the loading stage moves up and an output from the loading top face attitude sensor 83.

In the present example, the lower limit tray position detection sensor 84 is configured of a pair of optical sensors whose optical axis is blocked by the loading stage 80 lowered to a predetermined position, and detects that the loading stage 80 has lowered to the lower limit position.

In the present example, the loaded position detection sensor 85 is configured of a pair of optical sensors etc. whose axis is blocked by a position detection member 85*a* which projects from the loading guide face 80*c* and swings.

The loaded position detection sensor 85 detects a position of the booklet or the like loaded on the tray 81 along the paper-discharging direction from the discharge portion 75*c* based on whether or not the booklet loaded obliquely on the tray 81 along its slope is located at such a position that one side of the booklet or the like butts against the loading guide face 80*c* and presses the position detection member 85*a*.

The book-binding apparatus 2A has an outlet 21 on the front face side of the discharged paper stacker 8. The outlet 21 is formed so that the frame 20 is opened in the direction in which the tray 81 moves up and down and the tray 81, height of which may change in an elevation direction thereof in response to the number of booklets or the like, can be pulled out at any position.

Here, the book-binding apparatus 2A has no door over the outlet 21 so that booklet or the like can be taken out easily.

Further, the book-binding apparatus 2A has doors 22*a* and 22*b* on the front face of the frame 20 other than a position thereof where the outlet 21 is formed, and has a configuration, by opening the doors 22*a* and 22*b*, such that maintenance or the like of the first carriage path 3, the second carriage path 4, the punch-processing portion 5, the binder unit 6 and the discharge-processing portion 7 can be easily done.

As described above, in the book-binding apparatus 2A having the switchback type carriage path, it is possible to form a desired carriage path by combining linear or large-radius curve shaped carriage paths without forming such a carriage path that booklet or the like such as the booklet 100C stacking and binding a plurality of the paper sheets 100A or the bundle of paper sheets 100B stacking a plurality of the paper sheets 100A may curve sharply.

<Control Configuration Example of Paper-Sheet-Loading Device and Book-Binding Apparatus of the Present Embodiment>

Figure 12:
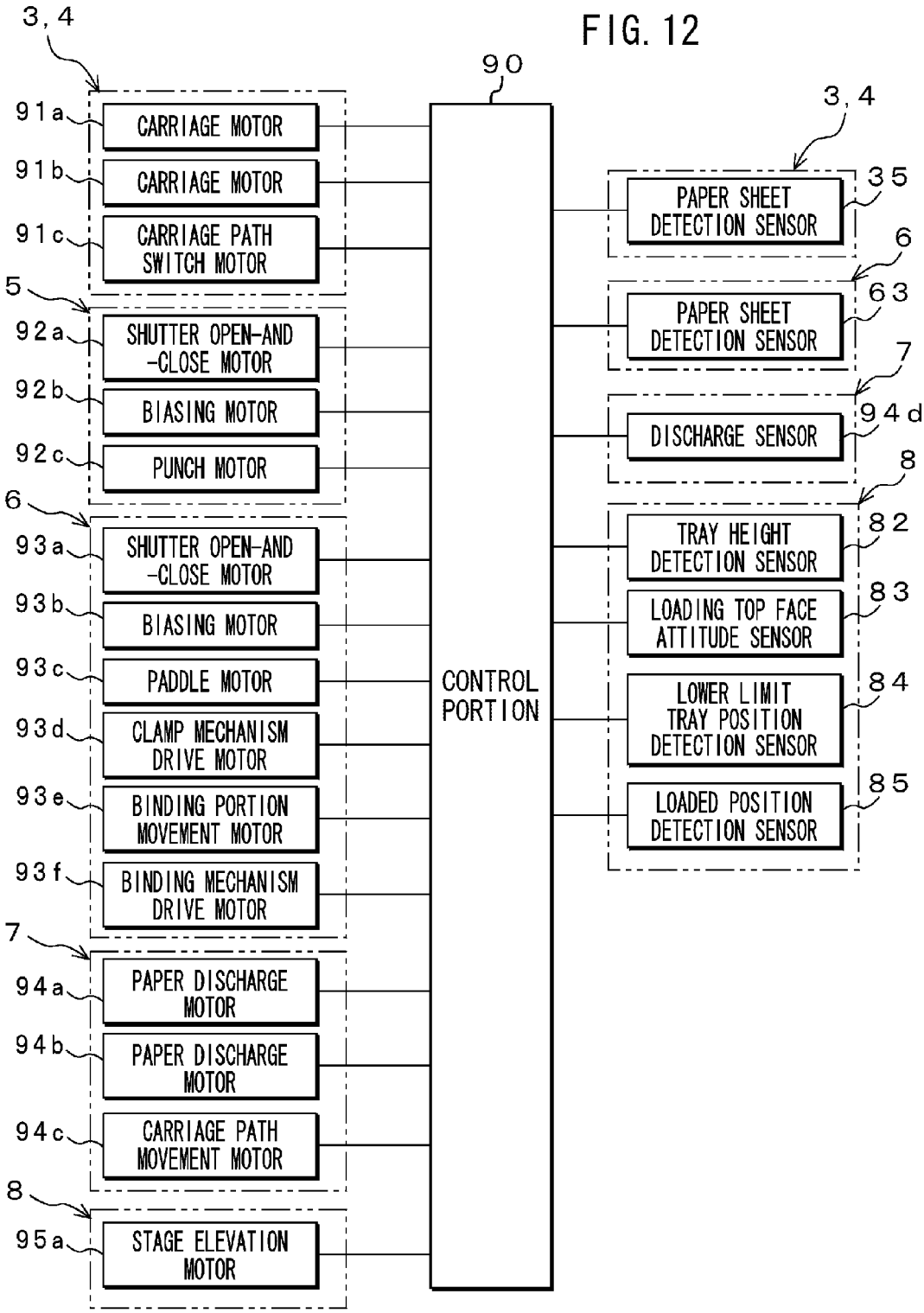
FIG. 12 is a control block diagram showing an example of a control system of the book-binding apparatus equipped with the paper-sheet-loading device.
Figure 13:
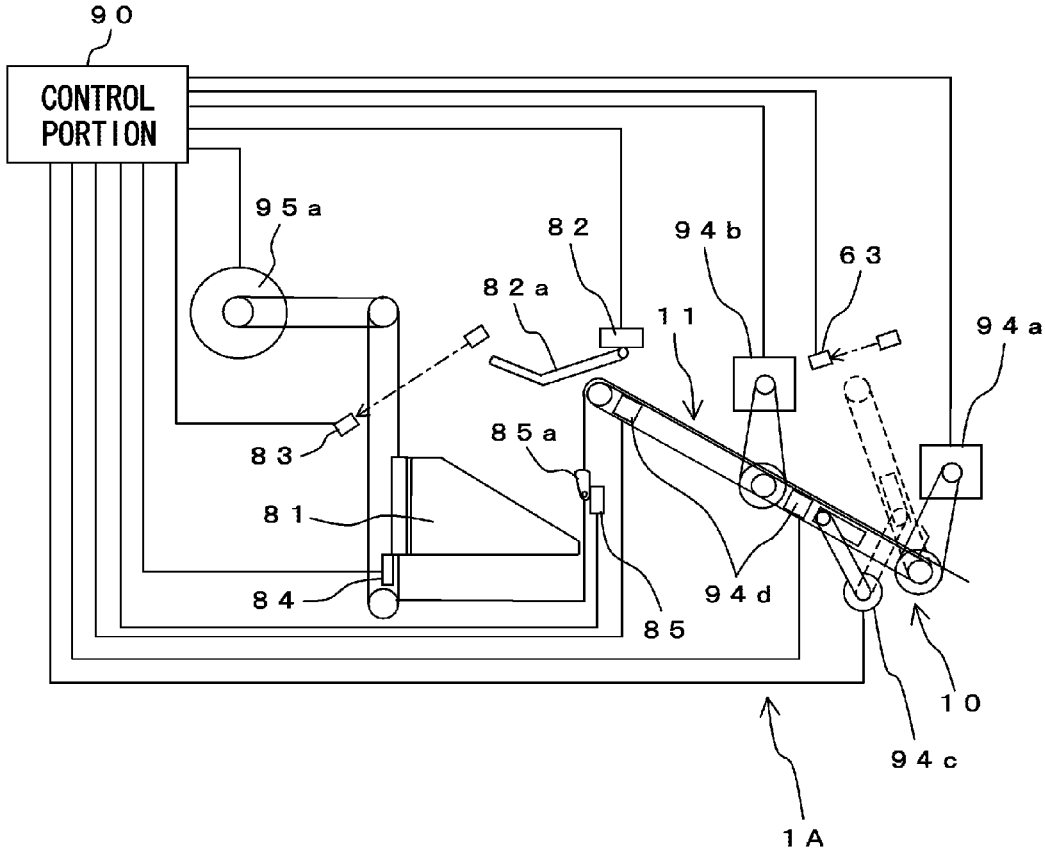
FIG. 13 is a functional block diagram showing an outline of a relationship between the control system and the configuration of the paper-sheet-loading device.

FIG. 12 is a control block diagram showing an example of a control system of the book-binding apparatus 2A equipped with the paper-sheet-loading device 1A. FIG. 13 is a functional block diagram showing an outline of a relationship between the control system and the configuration of the paper-sheet-loading device 1A.

The book-binding apparatus 2A is operated by an operation portion (not shown) etc. so that a control portion 90 as control means controls the first carriage path 3, the second carriage path 4, the punch-processing portion 5, the binder unit 6, and the discharge-processing portion 7 and the discharged paper stacker 8 of the paper-sheet-loading device 1A.

The first carriage path 3 and the second carriage path 4 are formed so that a carriage motor 91*a* which rotationally drives the feed roller 30*a* shown in FIG. 1, a carriage motor 91*a* which rotationally drives the feed roller 40*a*, a carriage path switch motor 91*c* which drives the switch blade 32, etc. are controlled by the control portion 90 in accordance with existence or nonexistence of paper sheet binding process and the output from the paper sheet detection sensor 35 etc.

The punch-processing portion 5 is formed so that a shutter open-and-close motor 92*a* which drives the butting shutter 50, a biasing motor 92*b* which drives the biasing mechanism portion 51, a punch motor 92*c* which drives the punch blade 52, etc. are controlled by the control portion 90 in accordance with the outputs of various kinds of the sensors such as a paper sheet detection sensor (not shown) provided in the punch-processing portion 5 etc.

The binder unit 6 is formed so that a shutter open-and-close motor 93*a* which drives the butting shutter 60*b* of the paper alignment portion 60, a biasing motor 93*b* which drives the biasing mechanism portion 60*c*, a paddle motor 93*c* which drives the paddle mechanism portion 60*d*, a clamp mechanism drive motor 93*d* which drives the clamp mechanism portion 60*e*, etc. are controlled by the control portion 90 in accordance with the outputs of various kinds of the sensors such as a paper sheet detection sensor (not shown) provided in the binder unit 6 etc.

The binder unit 6 is formed so that a binding portion movement motor 93*e* which swings the binding portion 62, a binding mechanism drive motor 93*f* which drives the binding mechanism portion 62*a* of the binding portion 62, etc. are controlled by the control potion 90 in accordance with the outputs of various kinds of the sensors (not shown) etc.

The discharge-processing portion 7 is formed so that a paper discharge motor 94*a* which rotationally drives the belt conveyance mechanism 70 of the first discharged paper sheet carriage path 10, a paper discharge motor 94*b* which rotationally drives the belt conveyance mechanism 74 of the second discharged paper sheet carriage path 11, a carriage path movement motor 94*c* which swings the first discharged paper sheet carriage path 10 by driving the carriage path movement mechanism 73, etc. are controlled by the control portion 90.

For example, the control portion 90 determines whether or not the booklet or the like such as the booklet 100C bound by the binder unit 6 or the unbound bundle of paper sheets 100B is properly delivered to the discharge-processing portion 7, based on the output of the paper sheet detection sensor 63. Then, based on whether or not the booklet or the like is properly delivered from the binder unit 6 to the discharge-processing portion 7, the control portion 90 performs processing to discharge a paper sheet or remove jammed paper by controlling the carriage path movement motor 94*c*, the paper discharge motor 94*a*, and the paper discharge motor 94*b*.

Further, the control portion 90 determines whether or not the booklet or not the like carried along the first discharged paper carriage path 10 is properly delivered to the second discharged paper carriage path 11 and the booklet or the like carried along the second discharged paper carriage path 11 is properly discharged to the discharged paper stacker 8 based on the output of the discharge sensor 94*d*, to perform processing to discharge paper or perform error handling etc.

Furthermore, the control portion 90 determines the position of the booklet or the like loaded on the tray 81 based on the output of the loaded position detection sensor 85 and controls the paper discharge motors 94*a* and 94*b* in accordance with the loaded position of the booklet or the like, to switch the paper discharge speed for the booklet or the like between high and low speeds.

The discharged paper stacker 8 is formed so that a stage elevation motor 95*a* etc. which move up and down the loading stage 80 by driving the stage elevation mechanism 80*a* are controlled by the control portion 90.

For example, the control portion 90 determines the loaded quantity of the booklet or the like loaded on the tray 81 and a loaded condition of the booklet or the like based on the outputs of the tray height detection sensor 82, the loading top face attitude sensor 83, and the lower limit tray position detection sensor 84 and then stops paper sheet binding process and discharging process based on the loaded quantity and loading condition of the booklet or the like.

<Operation Example of Paper-Sheet-Loading Device and Book-Binding Apparatus of the Present Embodiment> the following will describe an operation example of the book-binding apparatus 2A equipped with the paper-sheet-loading device 1A with reference to the drawings.

The book-binding apparatus 2A is connected to a copy machine etc. (not shown), and is supplied with paper sheets 100A on which a predetermined operation such as printing is conducted, one by one through the paper feed opening 31*a*.

In the case of processing of binding or punching the paper sheets in the book-binding apparatus 2A in accordance with a predetermined operation mode selected by manipulating an operation portion (not shown) by an operator, the carriage processing to carry the paper sheets 100A to the punch-processing portion 5 is performed and the alignment processing is performed in the binder unit 6 after the punch processing has been performed in the punch-processing portion 5.

Figure 14:
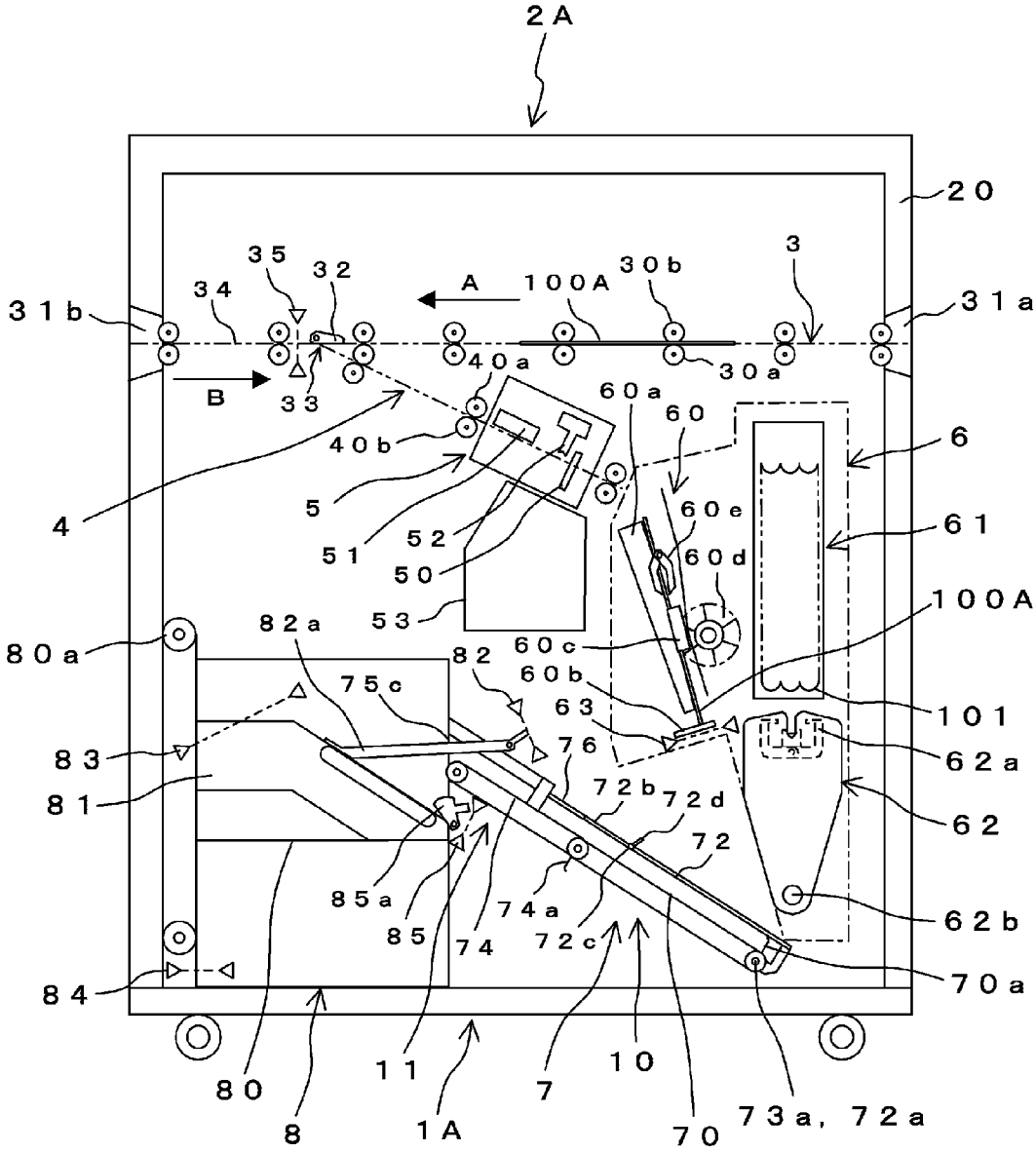
FIG. 14 is an explanatory operation diagram showing an example from carriage process to alignment process in the book-binding apparatus.

FIG. 14 is an explanatory operation diagram showing an example from the carriage processing to the alignment processing in the book-binding apparatus 2A.

In the carriage processing to carry the paper sheets 100A to the punch-processing portion 5, the control portion 90 controls the carriage motor 91*a* to rotationally drive the feed roller 30*a* of the first carriage path 3 so as to rotate the feed roller 30*a* in the forward rotation direction in which the paper sheets 100A are carried along the first carriage path 3 in the carriage direction A.

This causes the paper sheets 100A supplied to the first carriage path 3 to be sandwiched between the guide roller 30*b* and the feed roller 30*a* driven rotationally by the carriage motor 91*a* in the forward rotation direction and guided by the guide member (not shown), thus being carried along the first carriage path 3 in the carriage direction A from the paper feed opening 31*a* to the discharge opening 31*b*.

If the rear end of the paper sheet 100A being carried along the first carriage path 3 in the carriage direction A is detected by the paper sheet detection sensor 35 and when determining that the paper sheet 100A passes through the switch blade 32 and is carried to the reversal suspending portion 34 based on the output of the paper sheet detection sensor 35, the control portion 90 stops the carriage motor 91*a* to suspend the carriage of the paper sheet 100A.

After having suspended the carriage of the paper sheet 100A, the control portion 90 controls the carriage path switch motor 91*c* to drive the switch blade 32 rotationally and to switch the carriage direction by opening a carriage path from the reversal suspending portion 34 to the second carriage path 4.

When having switched the carriage direction to the second carriage path 4 by driving the switch blade 32 rotationally, the control portion 90 controls the carriage motor 91*a* to drive the feed roller 30*a* rotationally and to rotate the feed roller 30*a* in the reverse rotation direction in which the paper sheet 100A is carried along the first carriage path 3 in the carriage direction B. Further, it controls the carriage motor 91*b* to drive the feed roller 40*a* of the second carriage path 4 rotationally so as to rotate the feed roller 40*a* in a direction in which the paper sheet 100A is carried to the punch-processing portion 5 along the second carriage path 4.

This causes the paper sheet 100A temporarily reserved at the reversal suspending portion 34 to have the carriage direction reversed and be carried in the carriage direction B, to be fed from the first carriage path 3 up to the second carriage path 4, being guided by the switch blade 32.

The paper sheet 100A fed to the second carriage path 4 is sandwiched between the guide roller 40*b* and the feed roller 40*a* driven rotationally by the carriage motor 91*b* and guided by the guide member (not shown), thus being carried along the second carriage path 4 to the punch-processing portion 5.

For the punching process to punch the paper sheet 100A at the punch-processing portion 5, the control portion 90 controls the shutter open-and-close motor 92*a* to project the butting shutter 50 to the carriage path of the paper sheets 100A and also, controls the biasing motor 92*b* to drive the biasing mechanism portion 51.

With this, the end of the paper sheet 100A carried to the punch-processing portion 5 butts against the butting shutter 50 and the side end thereof butts against a reference guide (not shown) so that the alignment is performed.

After the paper sheet 100A is aligned, the control portion 90 controls the punch motor 92*c* to drive the punch blade 52 so as to punch predetermined holes in the paper sheet 100A and then controls the shutter open-and-close motor 92*a* to open the butting shutter 50. If the butting shutter 50 is opened, the paper sheet 100A punched by the punch-processing portion 5 is carried to the binder unit 6.

At the binder unit 6, first, to perform the alignment processing to pile up and align a predetermined number of the punched paper sheets 100A, the control portion 90 controls the shutter open-and-close motor 93*a* to project the butting shutter 60*b* to the temporary reserve portion 60*a*, controls the biasing motor 93*b* to drive the biasing mechanism portion 60*c*, and controls the paddle motor 93*c* to drive the paddle mechanism portion 60*d*.

Accordingly, the end of each of the paper sheets 100A punched by the punch-processing portion 5 and carried to the binder unit 6 butts against the butting shutter 60*b* and the side end thereof butts against the reference guide (not shown) so that the alignment is performed.

After the paper sheets 100A are aligned, the control portion 90 controls the clamp mechanism drive motor 93*d* to close the clamp mechanism portion 60*e*. When the clamp mechanism portion 60*e* is closed, the aligned paper sheets 100A are sandwiched and held at the clamp mechanism portion 60*e* without being misaligned.

Then, the carriage processing, the punch processing, and the alignment process mentioned above are repeated until the predetermined number of paper sheets 100A are aligned and piled up at the temporary reserve portion 60*a*.

When the punched paper sheets 100A are sequentially carried to the temporary reserve portion 60*a* and aligned and held at the clamp mechanism portion 60*e* as many as the predetermined number, the control portion 90 stops a series of the carriage processing, the punch processing, and the alignment processing.

Figure 15:
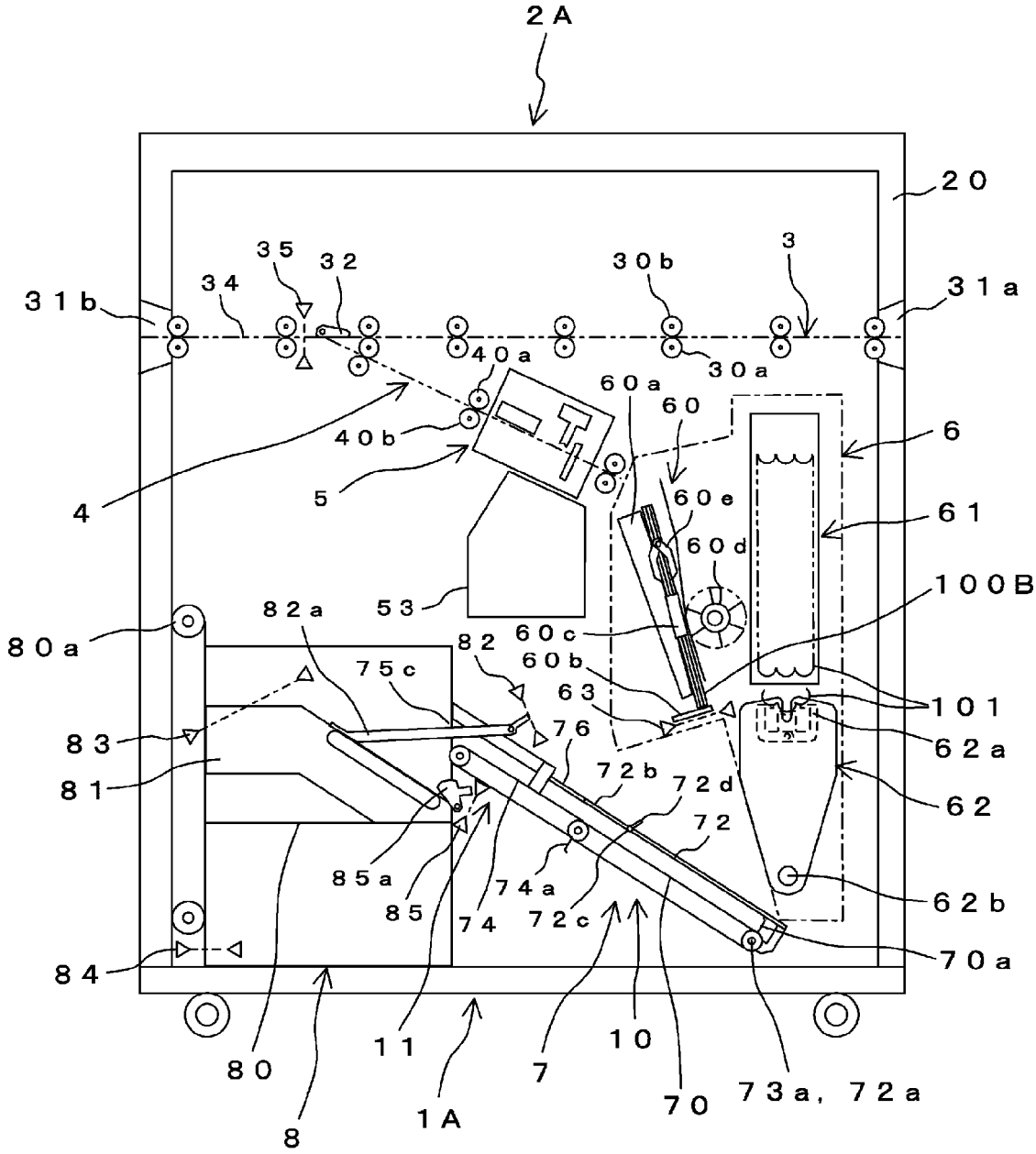
FIG. 15 is an explanatory operation diagram showing an example of a binding processing in the book-binding apparatus.
Figure 16:
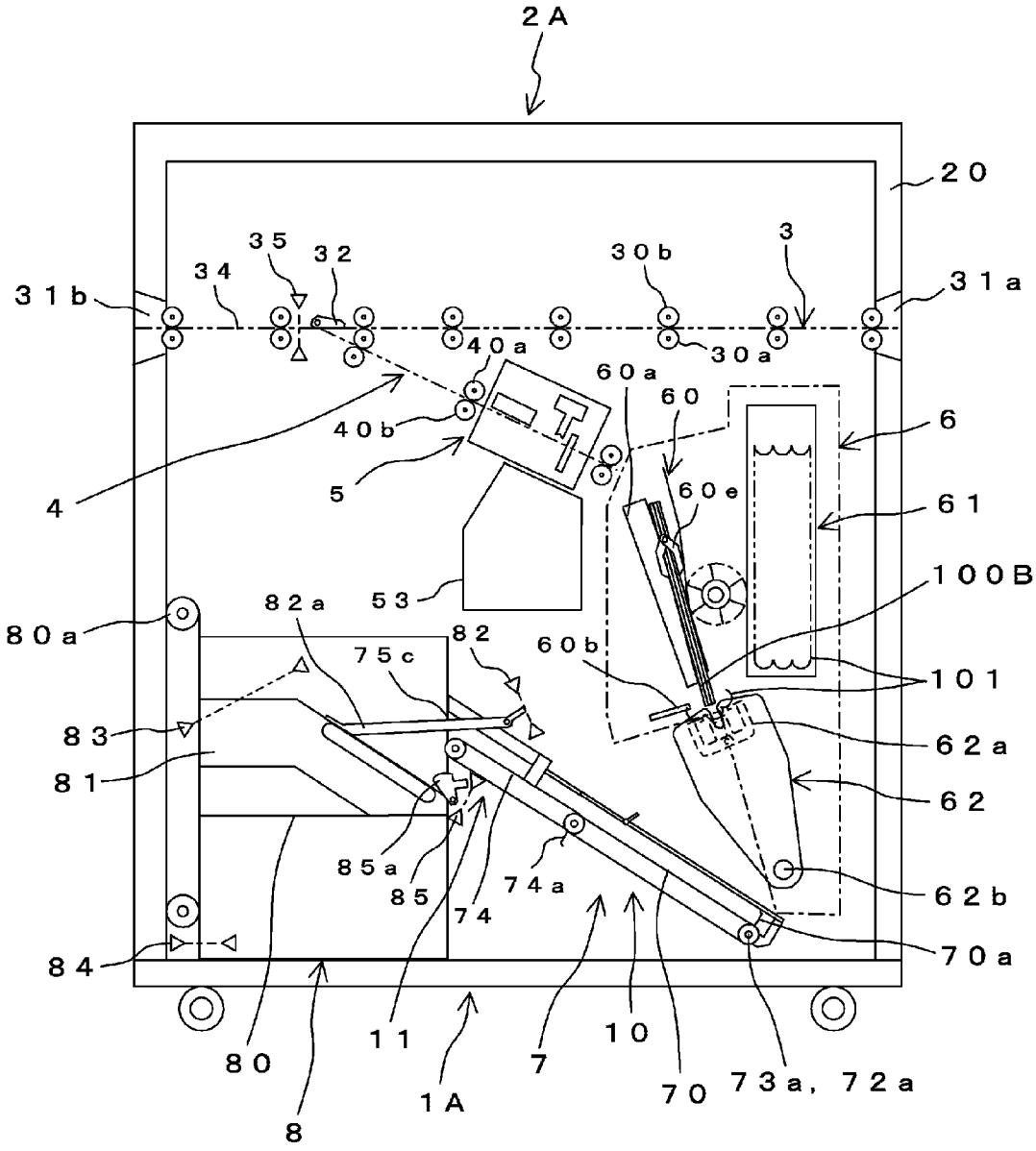
FIG. 16 is an explanatory operation diagram showing the example of the binding processing in the book-binding apparatus.

FIGS. 15 and 16 are explanatory operation diagrams showing an example of a binding processing in the book-binding apparatus 2A; FIG. 15 shows an operation of taking out the binding part 101 from the binding part stacker 61 and FIG. 16 shows an operation of binding the bundle of paper sheets 100B by the binding part 101.

At the binder unit 6, the binding part 62 is waiting at a binding part take-out position, so that in the case of performing a binding processing of binding the predetermined number of paper sheets 100A with the binding part 101, the control portion 90 controls the binding mechanism drive motor 93*f* to drive the binding mechanism portion 62*a*. The binding mechanism portion 62*a* grips the binding parts 101 stored in the binding part stacker 61 in a predetermined operation and, as shown schematically in FIG. 15, takes out one of the binding parts 101 from the binding part stacker 61 and holds it.

When the binding part 101 is taken out from the binding part stacker 61, the control portion 90 controls the binding portion movement motor 93*e* to drive the binding portion 62 rotationally and, as shown in FIG. 16, to swing the binding portion 62 around the rotational pivot 62*b* up to a paper sheet binding position.

Next, the control portion 90 controls the clamp mechanism drive motor 93*d* to drive the clamp mechanism portion 60*e* and to move the aligned and held bundle of paper sheets 100B to a predetermined process position and controls the binding mechanism drive motor 93*f* to drive the binding mechanism portion 62*a* and to bind the bundle of paper sheets 100B with the binding part 101. Accordingly, the bound booklet 100C in which the bundle of paper sheets 100B is bound with the binding part 101 is produced.

Figure 17A:
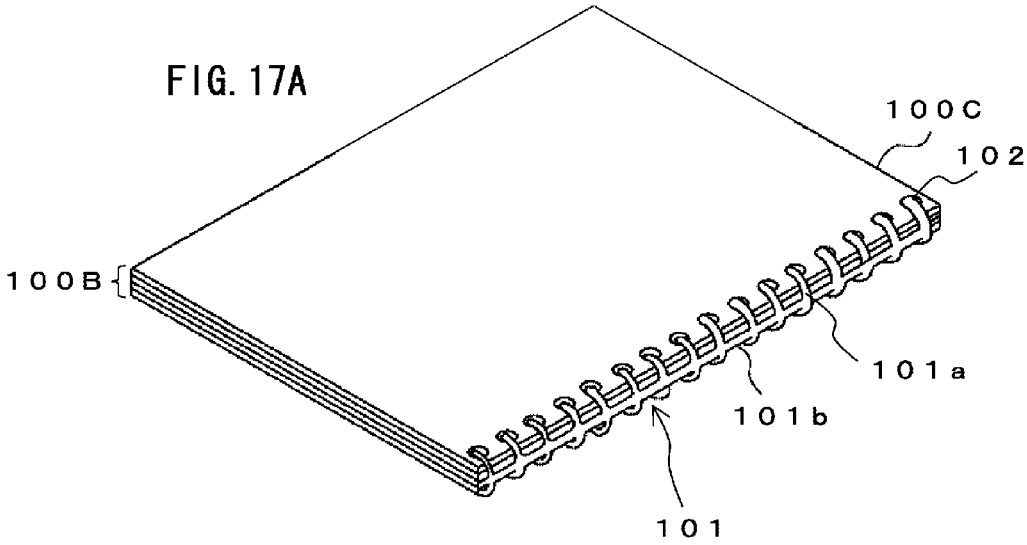
FIG. 17A is a perspective view showing an example of a booklet bound with a binding part.
Figure 17B:
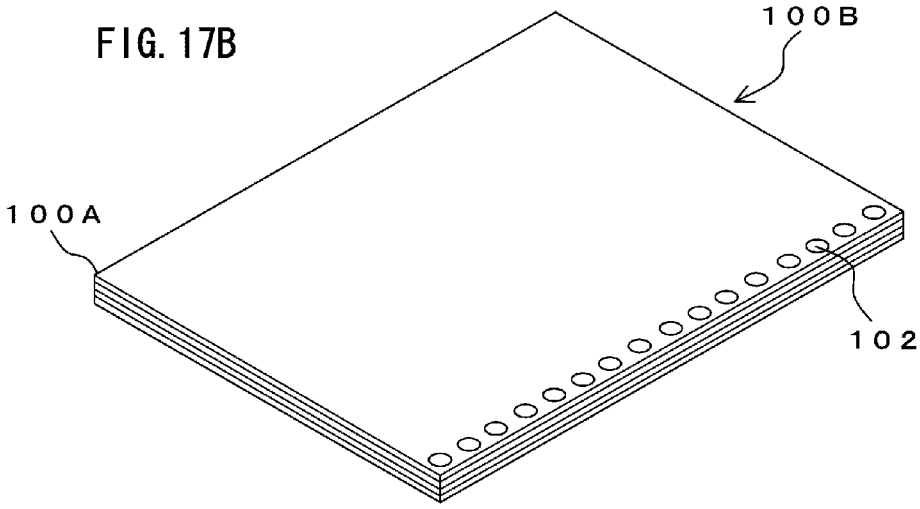
FIG. 17B is a perspective view showing an example of an unbound bundle of paper sheets.

FIG. 17A is a perspective view showing an example of the booklet 100C bound with a binding part 101 and FIG. 17B is a perspective view showing an example of the unbound bundle of paper sheets 100B. Further, FIGS. 18A and 18B are side views showing aspect examples of the booklet 100C owing to a difference in number of bound paper sheets.

The booklet 100C is one such that as shown in FIG. 17A, the bundle of the paper sheets 100B in which a plurality of the paper sheets each having holes 102 is piled up is bound with the binding part 101 and the binding part 101 has such an aspect that a plurality of ring portions 101*a* is tied up at a rear portion 101*b*.

The booklet 100C is produced by inserting open ring formation members of the binding part 101 into the holes 102 in the bundle of paper sheets 100B and tying them up in a circular manner so that the ring portions 101*a* may be formed.

Figure 18A:
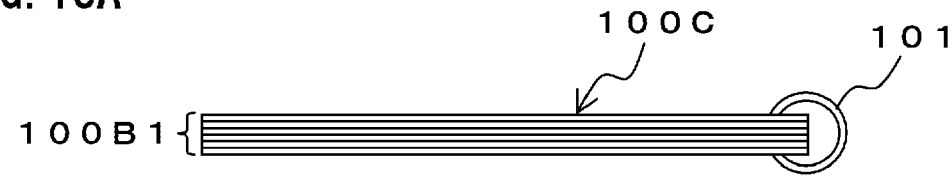
FIG. 18A is a side view showing an aspect example of the booklet owing to a difference in bound number thereof.
Figure 18B:
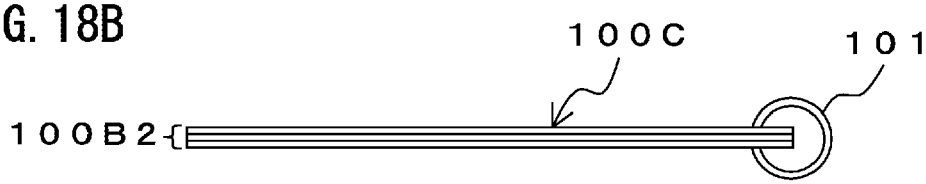
FIG. 18B is a side view showing an aspect example of the booklet owing to a difference in bound number thereof.

Here, a difference in number of the paper sheets to be bound can be accommodated by the same type of binding part 101, so that it is possible to produce the booklet 100C by binding a larger bundle of paper sheets 100B1 (which comprises 100 sheets, for example) such as shown in FIG. 18A and a smaller bundle of paper sheets 100B2 (which comprises 50 sheets, for example) such as shown in FIG. 18B by using the same type of binding part 101.

The bundle of paper sheets 100B as the booklet or the like is formed by piling up the paper sheets 100A each having the holes 102 formed therein by the punch processing in units of booklet.

Figure 19:
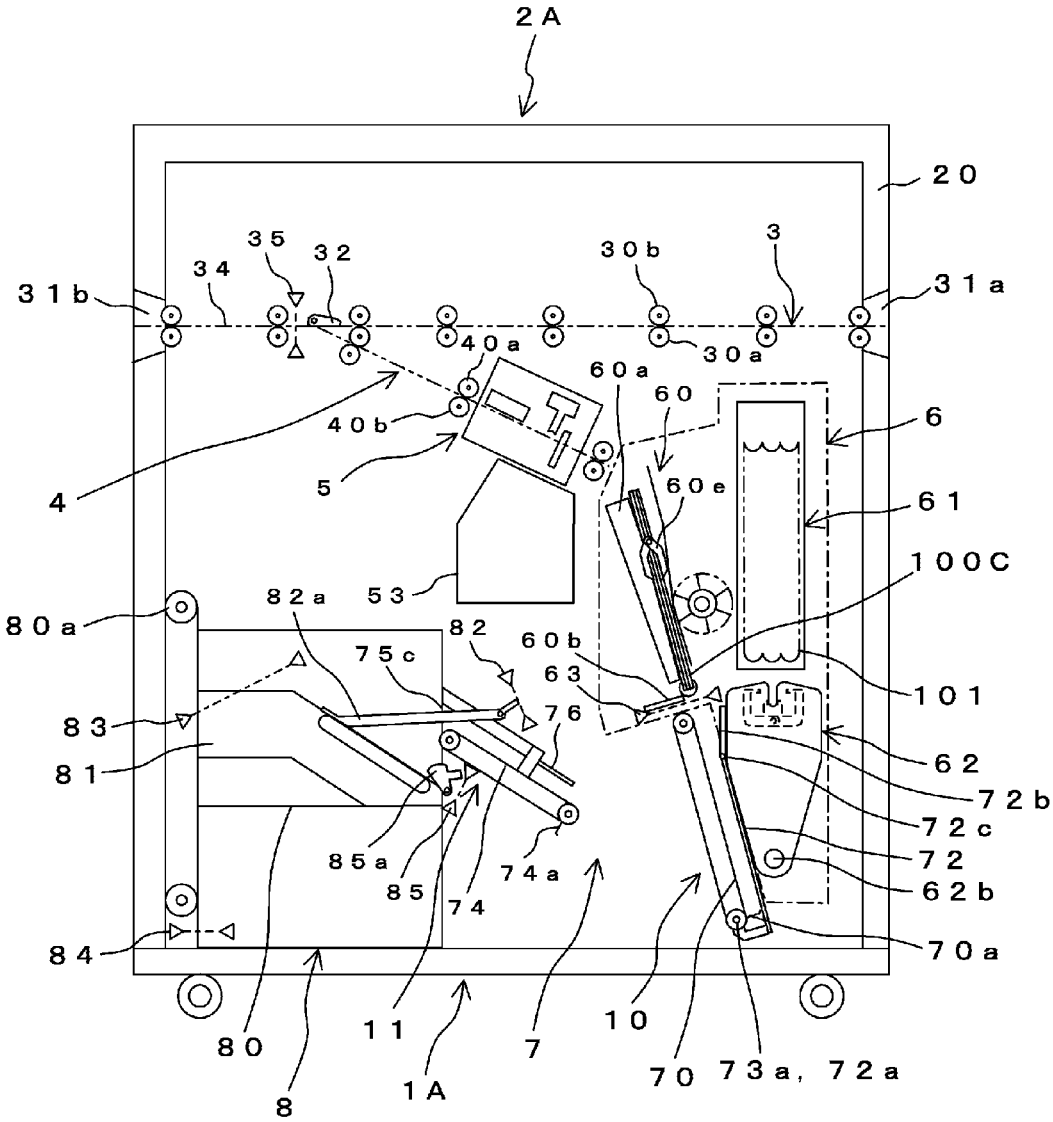
FIG. 19 is an explanatory operation diagram showing an example of a paper discharge process in the book-binding apparatus.
Figure 20:
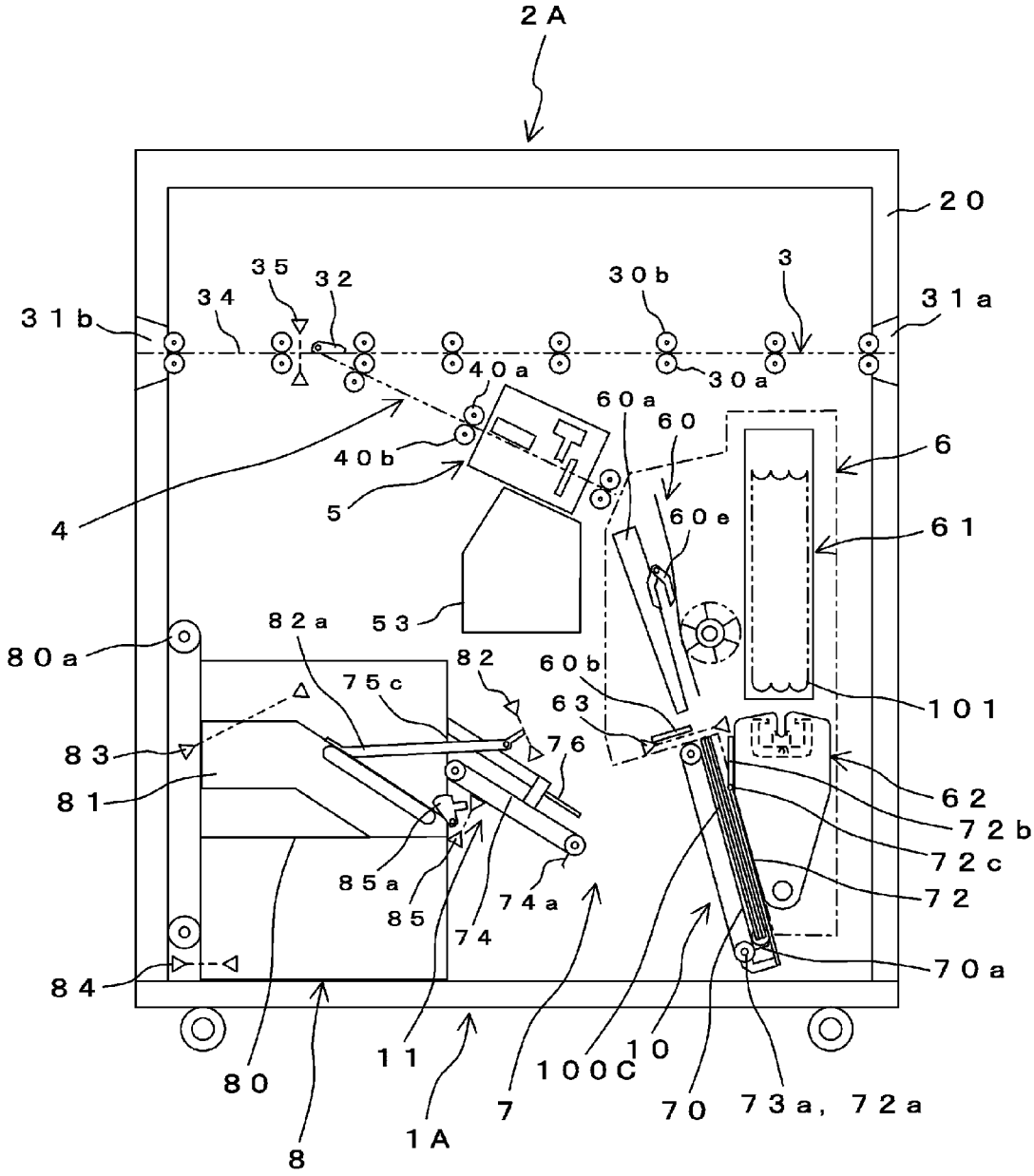
FIG. 20 is an explanatory operation diagram showing the example of the paper discharge process in the book-binding apparatus.
Figure 21:
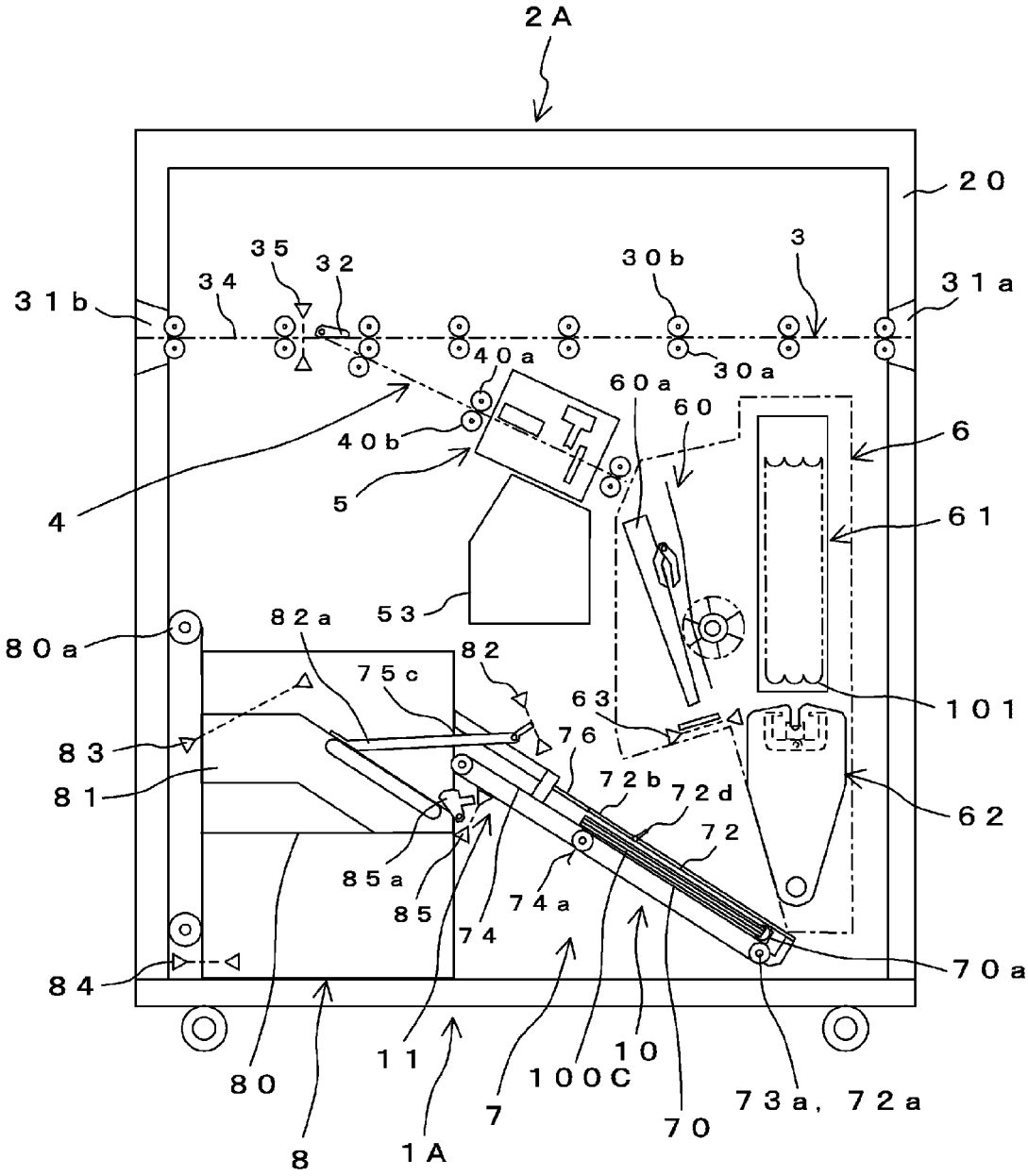
FIG. 21 is an explanatory operation diagram showing the example of the paper discharge process in the book-binding apparatus.
Figure 22:
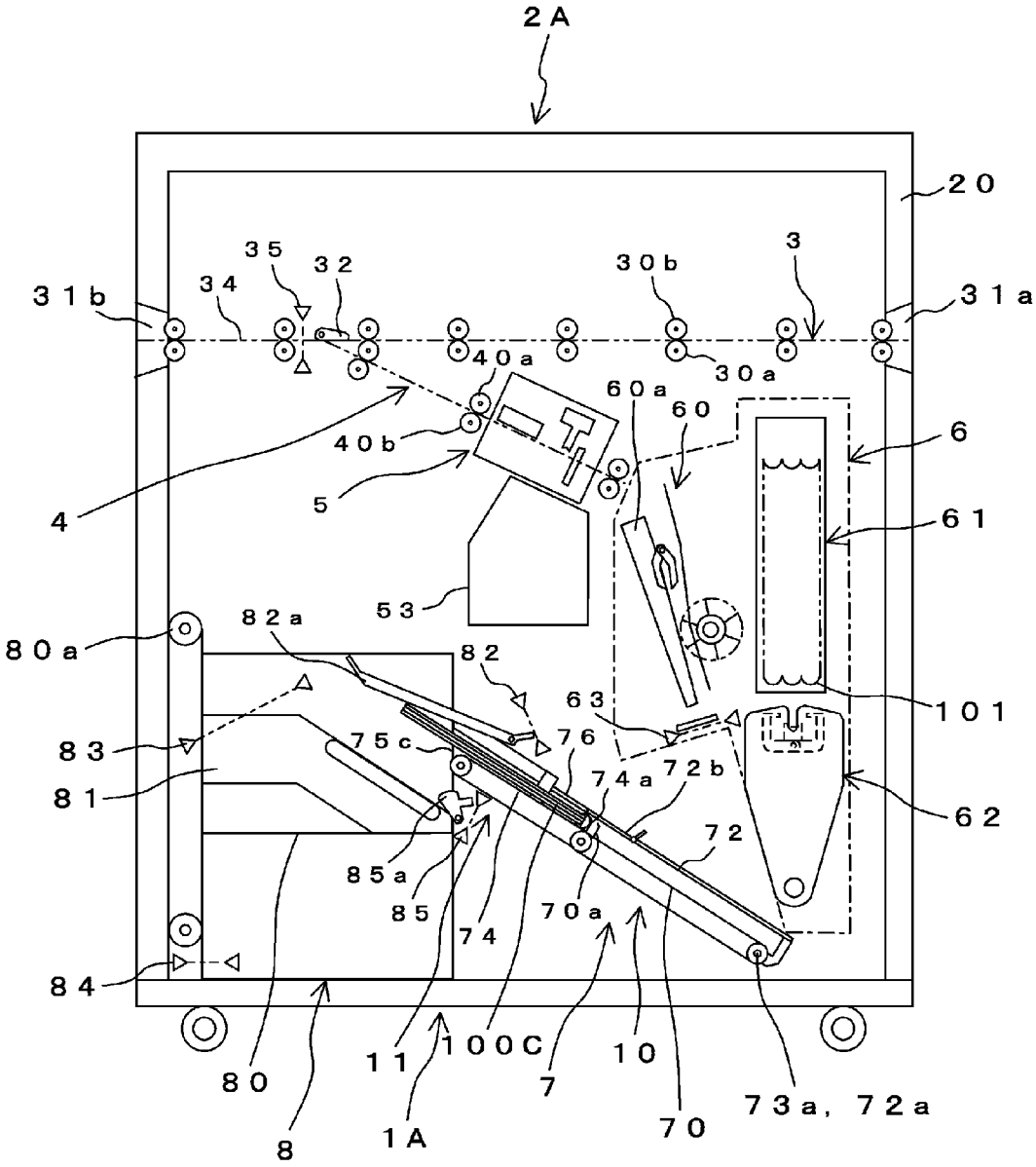
FIG. 22 is an explanatory operation diagram showing the example of the paper discharge process in the book-binding apparatus.
Figure 23:
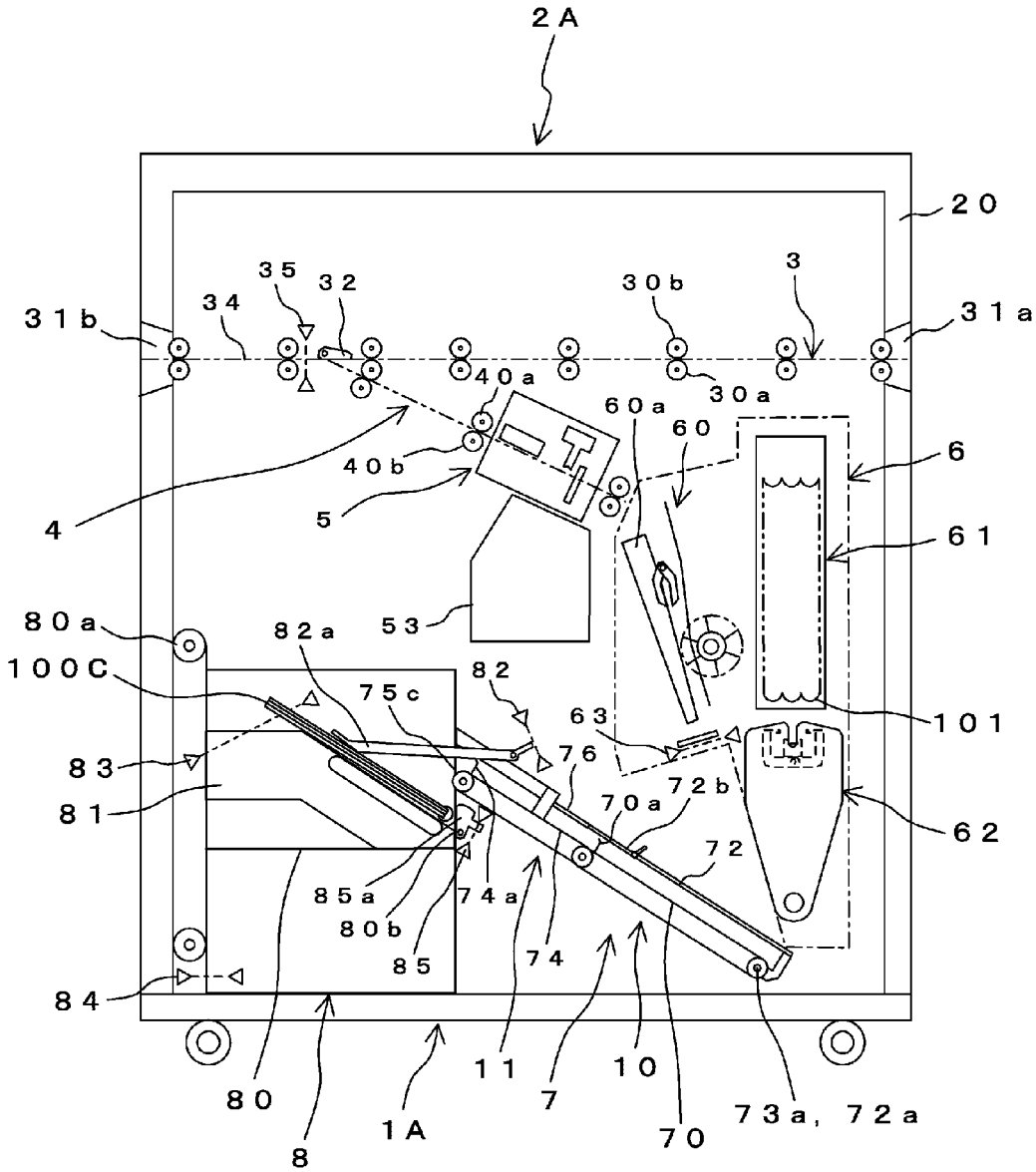
FIG. 23 is an explanatory operation diagram showing the example of the paper discharge process in the book-binding apparatus.

FIGS. 19 to 23 are explanatory operation diagrams showing an example of paper discharge process in the book-binding apparatus 2A; FIG. 19 shows an operation of moving the first discharged paper carriage path 10 of the discharge-processing portion 7 to a paper sheet receiving position thereof and FIG. 20 shows an operation of receiving booklet at the first discharged paper carriage path 10. Further, FIG. 21 shows an operation of moving the first discharged paper carriage path 10 to a paper sheet discharge position thereof, FIG. 22 shows an operation of carrying the booklet by the discharge-processing portion 7, and FIG. 23 shows an operation of discharging the booklet to the discharged paper stacker 8.

In a case where the booklet 100C is produced by binding the bundle of paper sheets 100B with the binding part 101 at the binder unit 6 or in a case where the bundle of paper sheets 100B is produced by piling up the punched paper sheets 100A in units of booklet, in order to discharge the booklet or the like, the control portion 90 controls the binding portion movement motor 93*e* to drive the binding portion 62 rotationally and to swing the binding portion 62 around the rotational pivot 62*b* as an axis so as to be moved to the binding part take-out position thereof.

Next, it controls the carriage path movement motor 94*c* to drive the first discharged paper carriage path 10 rotationally and to swing the first discharged paper carriage path 10 around the first rotational pivot 73*a* as an axis so as to e moved to the paper reception position thereof as shown in FIG. 19.

Accordingly, the first discharged paper carriage path 10 is formed so that the main guide member 71 and the accessory guide member 72 move to the paper sheet reception position in an interlocked manner and a carriage path formed between the main guide member 71 and the accessory guide member 72 faces the temporary reserve portion 60*a*, thus forming a carriage path from the binder unit 6.

Further, when the first discharged paper carriage path 10 has moved to the paper sheet reception position, the delivery guide 72*b* of the accessory guide member 72, the butting strip 72*d* of which butts against a butting portion (not shown) formed on the binder unit 6, is swung around the rotational pivot 72*c* as an axis so that its tip side is opened to the main guide member 71.

When the first discharged paper carriage path 10 has been moved to the paper sheet reception position thereof, the control portion 90 controls the clamp mechanism drive motor 93*d* to open the clamp mechanism portion 60*e*. When the clamp mechanism portion 60*e* has been opened, the booklets 100C etc. held at the temporary reserve portion 60*a* in the clamp mechanism portion 60*e* free-fall onto the carriage path formed between the main guide member 71 and the accessory guide member 72 as shown in FIG. 20.

At this point in time, the delivery guide 72*b* of the accessory guide member 72 guide the booklets 100C etc. fallen from the temporary reserve portion 60*a* to a place between the main guide member 71 and the accessory guide member 72 because its tip side serving as a portion for delivery from the binder unit 6 open to the main guide member 71. This enables the booklets 100C etc., even if curled, to be guided to the place between the main guide member 71 and the accessory guide member 72, thereby preventing occurrence of a jam.

When determining that the rear end of the booklet 100C etc. falling from the temporary reserve portion 60*a* is detected by the paper sheet detection sensor 63 and the booklet 100C etc. are properly carried to the first discharged paper carriage path 10 based on the output of the paper sheet detection sensor 63, the control portion 90 controls the carriage path movement motor 94*c* to drive the first discharged paper carriage path 10 rotationally and to swing the first discharged paper carriage path 10 around the first rotational pivot 73*a* as an axis so as be moved to the paper sheet discharge position as shown in FIG. 21.

The first discharged paper carriage path 10 is formed so that in a condition where the booklet 100C etc. have been properly carried from the binder unit 6, no loads resisting against the movement to the paper sheet discharge position are applied on the accessory guide member 72 by the movement from the paper sheet reception position to the paper sheet discharge position, so that the accessory guide member 72 is interlocked with the main guide member 71 to move to the paper sheet discharge position, thus forming a carriage path leading to the second discharged paper carriage path 11.

Further, when the first discharged paper carriage path 10 has moved to the paper sheet discharge position, as the butting strip 72*d* is separated from the butting portion (not shown), the delivery guide 72*b* of the accessory guide member 72 faces the guide face 71*a* of the main guide member 71 roughly in parallel, thus serving as a carriage guide leading to the second discharged paper path 11.

In such a manner, since the delivery guide 72*b* is opened and closed while the first discharged paper carriage path 10 is moving between the paper sheet reception position and the paper sheet discharge position, no drive means is necessary, so that with simple configuration, one guide member can have the function of a guide to receive booklet or the like from the binder unit 6 and the function of a guide to deliver the booklet or the like to the second discharged paper carriage path 11.

Moving the first discharged paper carriage path 10 to the paper sheet discharge position, the control portion 90 controls the paper discharge motor 94*a* to drive the belt conveyance mechanism 70 rotationally. When the belt conveyance mechanism 70 has been driven rotationally, the first discharged paper carriage path 10 moves toward the second discharged paper carriage path 11 while the catcher 70*a* are supporting the booklets 100C etc., thereby carrying the booklet 100C etc. to the second discharged paper carriage path 11.

When the booklet 100C etc. have been carried to the position for delivery to the second discharged paper carriage path 11, the control portion 90 stops the paper discharge motor 94*a* and also controls the paper discharge motor 94*b* to drive the belt conveyance mechanism 74 of the second discharged paper carriage path 11.

When the belt conveyance mechanism 74 has been driven rotationally, as shown in FIG. 22, the second discharged paper carriage path 11 receives the booklet 100C etc. supported by the catcher 70*a* of the first discharged paper carriage path 10, by using the catcher 74*a*. The catcher 74*c* that has caught the booklet 100C etc. moves toward a direction of the discharged paper stacker 8 with it supporting the booklet 100C etc., and carries the booklet 100C etc. to the discharged paper stacker 8.

Here, the delivery guide 72*b* of the accessory guide member 72 faces the guide face 71*a* of the main guide member 71 roughly in parallel and so guides the booklet 100C etc. carried along the first discharged paper carriage path 10 between the main guide member 75 and the accessory guide member 76 of the second discharged paper carriage path 11.

When the catcher 74*a* has moved to a predetermined position along the second discharged paper carriage path 11, the booklet 100C etc. carried along the second discharged paper carriage path 11 are discharged through the discharge portion 75*c* onto the discharged paper stacker 8 as shown in FIG. 23.

The booklet 100C etc. discharged onto the discharged paper stacker 8 from the discharge portion 75*c* are loaded on the loading face 81*a* of the tray 81.

Figure 24A:
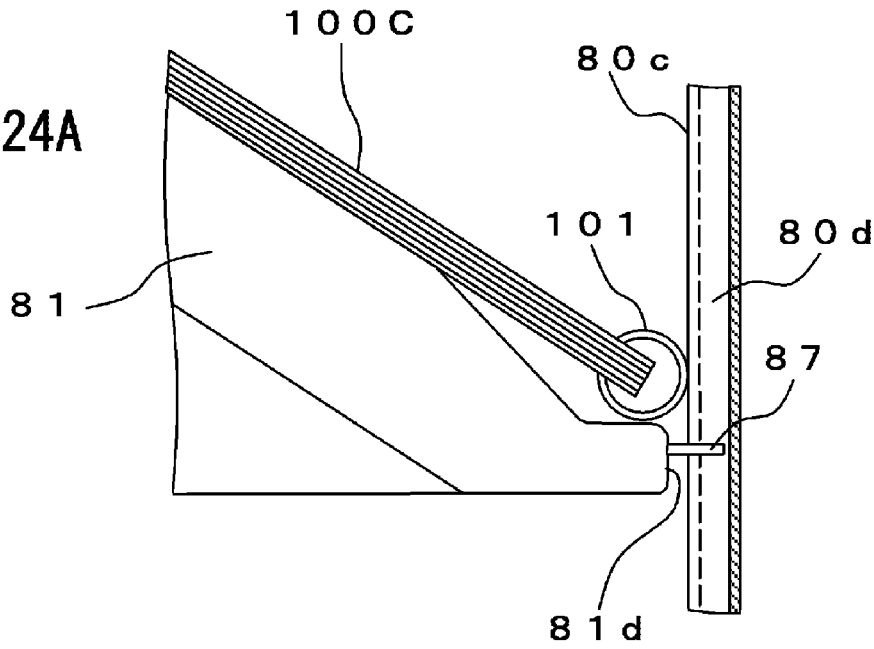
FIG. 24A is an explanatory operation diagram showing an example of a loaded condition of a booklet bound by a binding part.
Figure 24B:
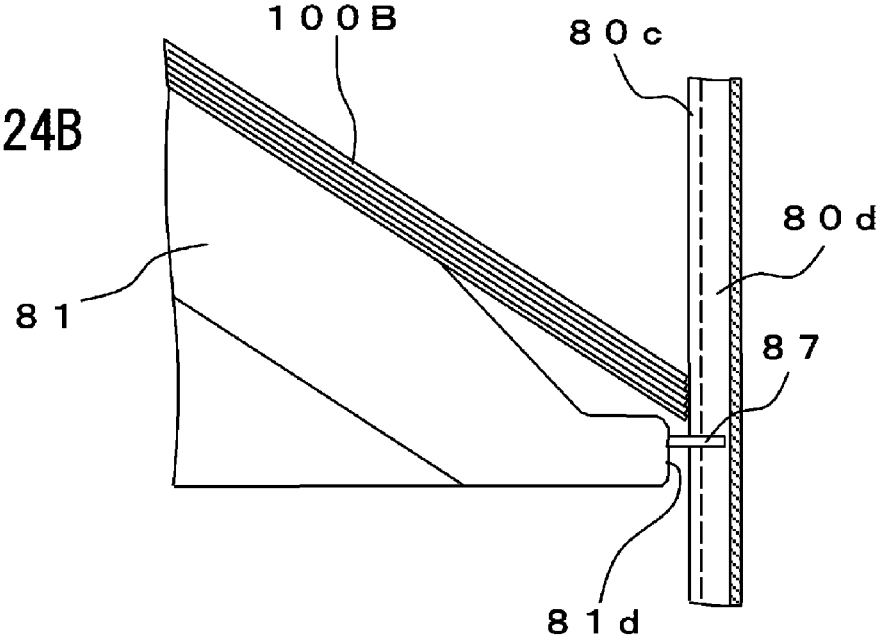
FIG. 24B is an explanatory operation diagram showing an example of a loaded condition of a bundle of unbound paper sheets.

FIG. 24A is an explanatory operation diagram showing an example of loaded condition of a booklet bound by a binding part and FIG. 24B is an explanatory operation diagram showing an example of a loaded condition of an unbound bundle of paper sheets. When the tray 81 is located at the loading position, the projection portion 87*c* of the fall prevention member 87 projects through the end face 81*d* of the tray 81 into the guide groove 80*d* in the loading guide face 80*c* as shown in FIG. 11A.

Accordingly, a part of the gap between the end face 81*d* of the tray 81 and the loading guide face 80*c* is closed by the fall prevention member 87, thereby preventing the booklet 100C etc. loaded on the tray 81 from dropping through the gap as shown in FIG. 24A.

In particular, in the case of loading the unbound bundle of paper sheets 100B as shown in FIG. 24B, the paper sheets are liable to be rendered apart from each other and to be fallen through the gap between the tray 81 and the loading guide face 80*c*; however, it is possible to prevent even one sheet of paper from falling by closing the gap with the fall prevention member 87.

When the booklet 100C etc. have been carried to the discharged paper stacker 8, the control portion 90 stops the paper discharge motor 94*b*. Further, the control portion 90 controls the stage elevation motor 95*a* to move down the loading stage 80 by a predetermined distance, thus securing a space on the tray 81 for receiving the next booklet 100C etc.

In the present example, it is configured so that when the tray height detection sensor 82 detects that the height detection lever 82*a* of the tray height detection sensor 82 has been pressed up by the booklet 100C etc. loaded on the tray 81, a space to receive the next booklet 100C etc. will be secured on the tray 81.

For this purpose, the control portion 90 controls the stage elevation motor 95*a* to move down the loading stage 80 and then, to move up the loading stage 80 until the tray height detection sensor 82 detects that its height detection lever 82*a* has been pressed up by the booklet 100C etc. loaded on the tray 81, thus securing a space on the tray 81 to receive the next booklet 100C etc.

Here, when the tray 81 is located at the loading position, the projection portion 87*c* of the fall prevention member 87 is in the guide groove 80*d* in the loading guide face 80*c*, which, however, does not interfere with the tray 81 moving up or down because a gap is formed between the projection portion 87*c* and the guide groove 80*d*.

Further, the control portion 90 determines the position of the booklet 100C etc. loaded on the tray 81 based on the output of the loaded position detection sensor 85 and prevents the binding parts 101 from overlapping by, if the loaded position of the booklet 100C gets closer to the loading guide face 80*c*, speeding up the discharging of the next booklet 100C and, if the loaded position of the booklet 100C is more separate from the loading guide face 80*c*, slowing down the discharging, thereby keeping the balance of loading.

Figure 25A:
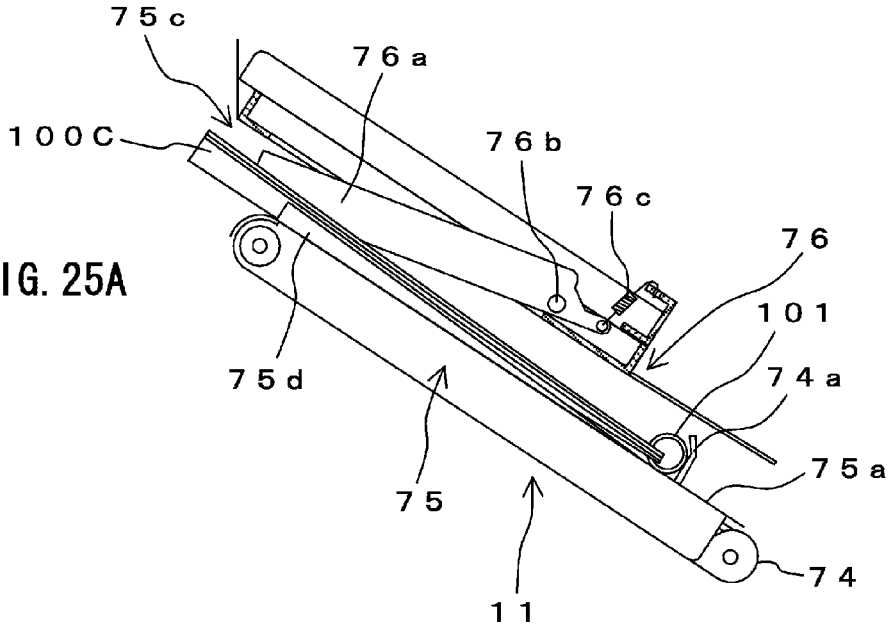
FIG. 25A is a partially exploded side view of the discharge portion showing an example of operation during a period of paper discharge process time.
Figure 25B:
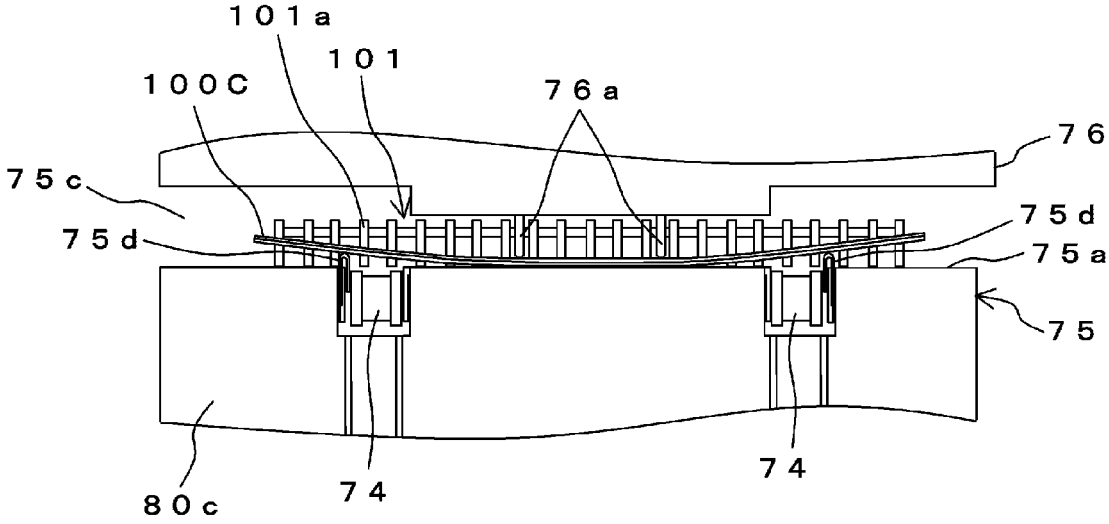
FIG. 25B is a front view of the discharge portion showing an example of the operation during a period of paper discharge process time.

FIG. 25A is a partially exploded side view of the discharge portion 75*c* showing an example of operations during a period of the paper discharge process time and FIG. 25B is a front view of the discharge portion 75*c* showing an example of the operation during a period of the paper discharge process time.

The lower side stiffening members 75*d* project from the main guide member 75 and the upper side stiffening members 76*a* project from the accessory guide member 76, in the discharge portion 75*c* of the second discharged paper carriage path 11. In the present example, the lower side stiffening members 75*d* are disposed outside each of the upper side stiffening members 76*a*, so that the booklet 100C etc. passing through the discharge portion 75*c* are curbed right and left with respect to the carriage direction, thereby being, so-called, stiffened so that they may not easily bent in the carriage direction.

Further, the lower side stiffening members 75*d* and the upper side stiffening members 76*a* are inclined in such a manner that they may project more as they get closer to the discharge portion 75*c* along the carriage direction of the booklet 100C etc., so that the booklet 100C etc. passing through the discharge portion 75*c* are discharged through the discharge portion 75*c* as being stiffened gradually as shown in FIG. 25A.

This causes the booklet 100C etc. discharged through the discharge portion 75*c* to be loaded on the tray 81 of the discharged paper stacker 8 without being buckled.

Here, spacing between the lower side stiffening members 75*c* and the upper side stiffening members 76*a* are set different from a pitch for the ring portions 101*a* of the binding part 101. Further, the thickness of each of the lower side stiffening members 75*d* and that of each of the upper side stiffening member 76*a* are set smaller than the spacing between the adjacent ring portions 101*a*.

Accordingly, the booklet 100C passing through the discharge portion 75*c* can have its paper sheet portion stiffened in a condition where the ring portions 101*a* of the binding part 101 may not be run over the lower side stiffening member 75*d* or the upper side stiffening member 76*a*.

Further, the upper side stiffening member 76*a* is configured so as to swing around the rotational pivot 76*b* as an axis and is raised in accordance with the thickness of the booklet 100C passing through the discharge portion 75*c* so that the spacing may change with respect to the guide face 75*a* of the main guide member 75.

Therefore, the discharge portion 75*c* having a configuration to stiffen the booklet 100C accommodates a difference in thickness of the booklet 100C caused by a difference in number of paper sheets bound and a difference in diameter of the ring portions 101*a* of the binding part 101 such as shown in FIGS. 18A and 18B. It is to be noted that if the booklet 100C has passed through the discharge portion 75*c*, the upper side stiffening member 76*a* which has been pushed up returns to its original position owing to the urging force of the spring 76*c*.

The following will describe operation of taking out the booklets 100C etc. loaded on the tray 81. The operator or the like holds the handle portion 81*b* of the tray 81 located at the loading position and pulls the tray 81 toward the near side as shown in FIG. 2.

The tray 81 is supported slidably by the slide rails 86 as shown in FIGS. 7 and 8 and is pulled out to the take-out position shown in FIG. 3 if it is pulled toward the near side.

By pulling out the tray 81 to the take-out position, the booklet 100C etc. loaded on the tray 81 are pulled out through the outlet 21, so that it is possible to take out the booklet 100C etc., easily.

The book-binding apparatus 2A of the present example is disposed between, for example, a copy machine and a post-handling apparatus, so that the discharged paper stacker 8 cannot be mounted as exposed on the side face etc. of the apparatus. Therefore, the discharged paper stacker 8 has been mounted inside the apparatus; however, the tray 81 is configured to be able to be pulled out toward the near side through the outlet 21, thus making it possible to easily take out the booklets 100C etc. loaded on the tray 81 even with a large difference in number of the booklets 100C etc.

Here, if the tray 81 is located at the loading position, the projection portion 87*c* of the fall prevention member 87 is present in the guide groove 80*d* of the loading guide face 80*c* as shown in FIG. 10A. If the tray 81 is pulled out in this condition, the projection portion 87*c* butts against the guide groove 80*d* so that the projection portion 87*c* receives pushed force.

Accordingly, as shown in FIG. 11B, the fall prevention member 87 swings around the support 87*a* as an axis against the spring 87*b* so that the projection portion 87*c* may retreat, thus not interfering with the pull-out of the tray 81. In this case, the fall prevention member 87 is urged by the spring 87*b* so that the projection portion 87*c* may come in sliding contact with the loading guide face 80*c*, thereby preventing the booklet or the like from dropping through the gap between the tray 81 and the loading guide face 80*c*.

After taking out the booklet 100C etc. from the tray 81 pulled out to the take-out position, the operator etc. hold the handle portion 81*b* and push in the tray to the loading position. Here, if the tray 81 is pushed in from the take-out position, the projection portion 87*c* of the fall prevention member 87 butts against the loading guide face 80*c* so that the projection portion 87*c* receives pushed force.

Accordingly, as shown in FIG. 11B, the fall prevention member 87 swings around the support 87*a* as an axis against the spring 87*b* so that the projection portion 87*c* may retreat, thus not interfering with the push-in of the tray 81.

In this case, the fall prevention member 87 is urged by the spring 87*b* so that the projection portion 87*c* may come in sliding contact with the loading guide face 80*c*, thereby preventing the booklet or the like from dropping through the gap between the tray 81 and the loading guide face 80*c*.

If the tray 81 has been pushed in to the loading position, the projection portion 87*c* of the fall prevention member 87 faces the guide groove 80*d* of the loading guide face 80*c*, so that the fall prevention member 87 swings around the support 87*a* as an axis owing to the spring 87*b* so that the projection portion 87*c* may projects out into the guide groove 80*d* as shown in FIG. 11A.

It is to be noted that in the operation of pulling out the tray 81 from the loading position to the take-out position, owing to a main cause such that there are many the loaded booklets 100C etc. or the like, some of the loaded booklets 100C etc. may remain without following the pulling-out operation of the tray 81.

The tray 81 has the auxiliary loading member 80*b* at its lower part, and the auxiliary loading member 80*b* closes the lower rear space of the tray 81 when the tray 81 is pulled out to the take-out position. Accordingly, even if the booklets 100C etc. remain as they are without following the pulling-out operation of the tray 81, the booklets 100C etc. are loaded on the auxiliary loading member 80*b* and not fall to the rear space of the tray 81.

Further, since the auxiliary loading member 80*b* has a shape after the loading face 81*a* of the tray 81, even if the booklets 100C etc. loaded on the tray 81 are moved over onto the auxiliary loading member 80*b* by the pulling-out operation of the tray 81, it prevents them from being collapsed in the outlet 21 owing to unbalance in loading.

Furthermore, when the tray 81 located at the take-out position is pushed back to the loading position in a condition where the booklets 100C etc. are loaded on the auxiliary loading member 80*b*, these booklets 100C etc. loaded on the auxiliary loading member 80*b* are run over the guiding portion 81*c* of the tray 81 and loaded on the loading face 81*a*.

In such a manner, if for example it is tried to placing the booklets 100C etc. loaded on the auxiliary loading member 80*b* back onto the tray 81 by pushing in the tray 81 to the loading position, the booklets 100C etc. can be loaded on the tray 81 again without being damaged.

It is to be noted that even if the tray 81 is pulled out to the take-out position mistakenly during the operation of the apparatus, the auxiliary loading member 80*b* is to configure a tray, thereby preventing the booklets 100C etc. discharged through the discharge portion 75*c* from falling off the tray 81.

Figure 26:
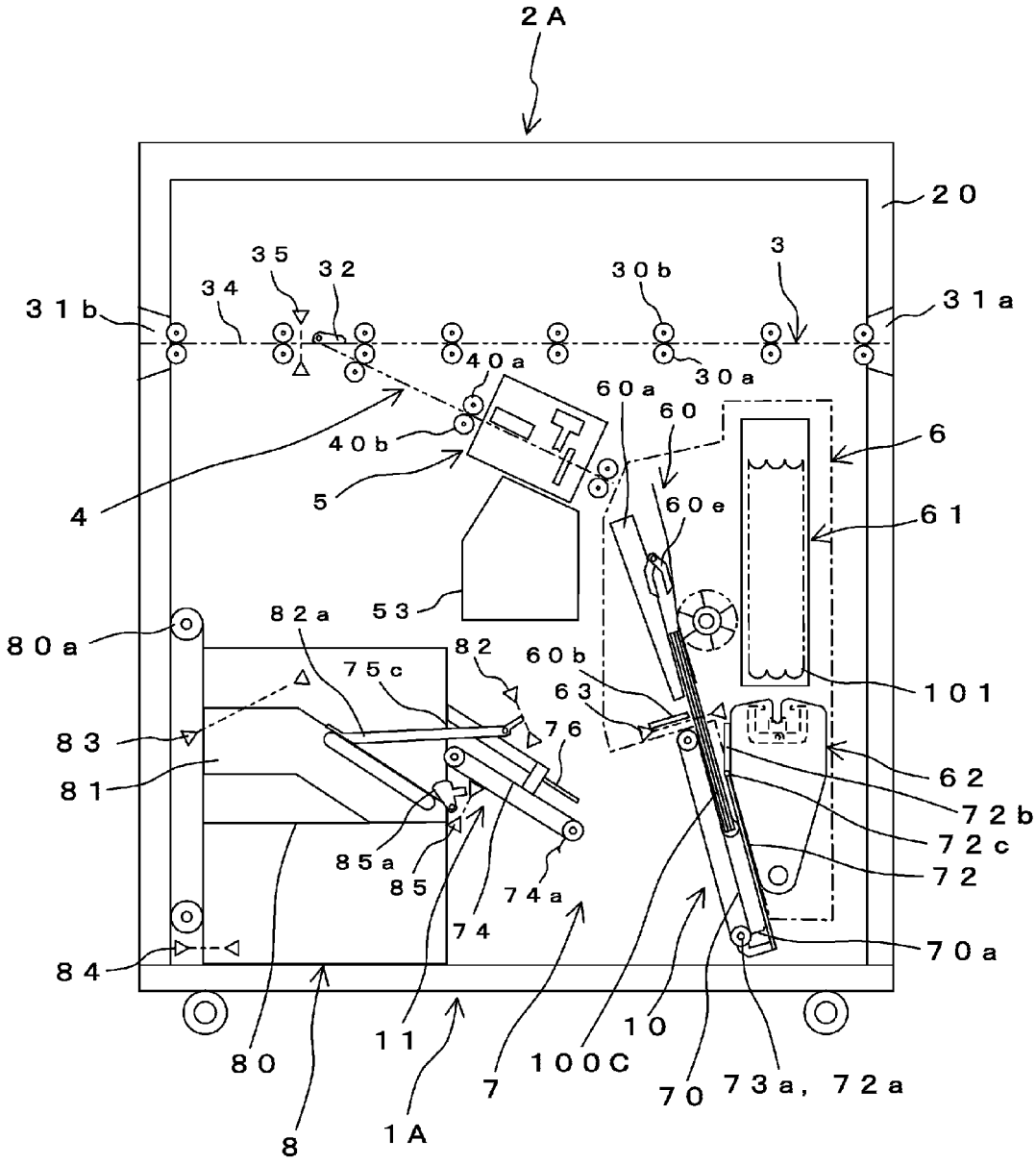
FIG. 26 is an explanatory operation diagram showing an example of handling in the book-binding apparatus during a period of carriage error time.
Figure 27:
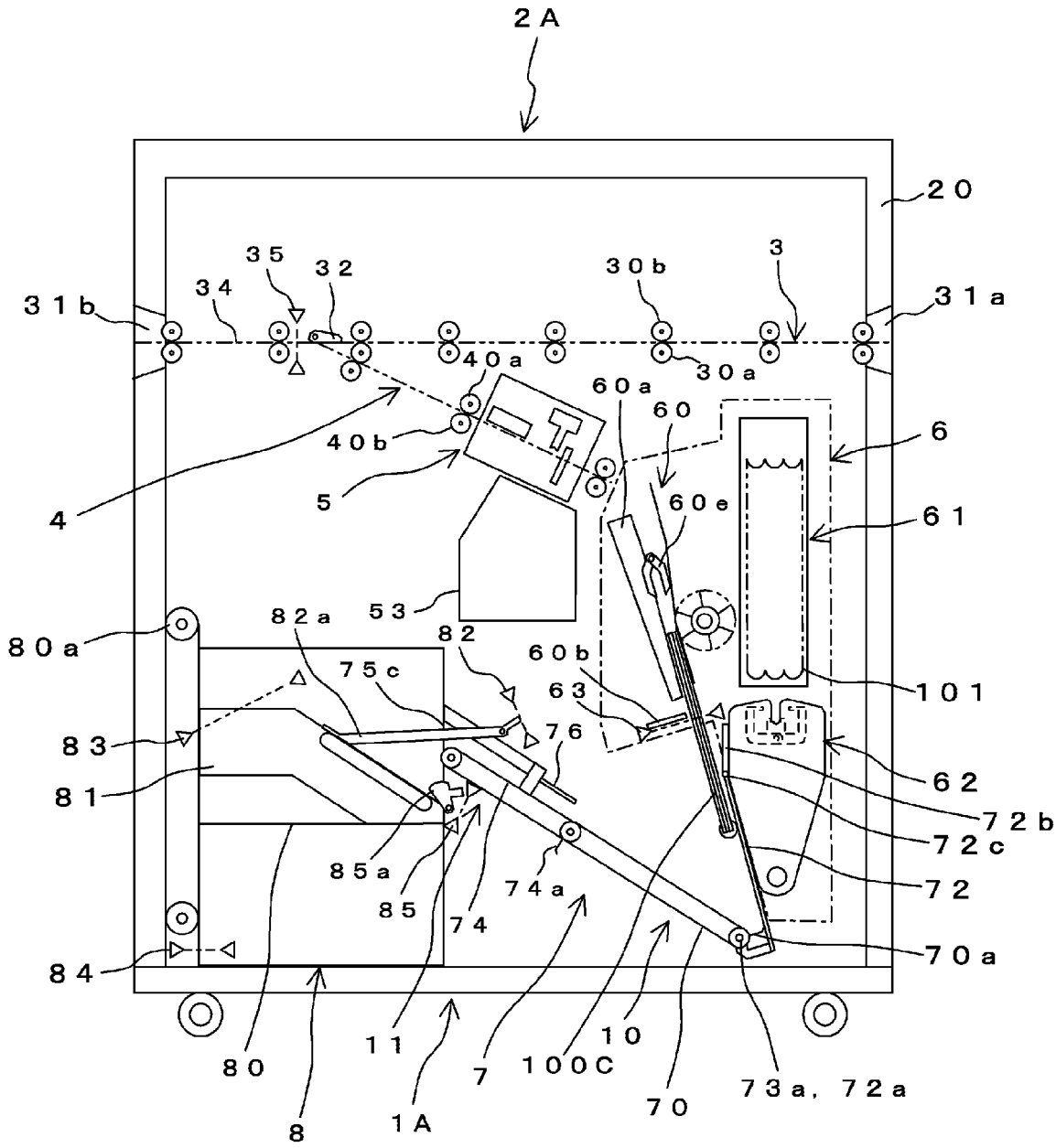
FIG. 27 is an explanatory operation diagram showing the example of the handling in the book-binding apparatus during a period of carriage error time.

FIGS. 26 and 27 are explanatory operation diagrams showing an example of handling in the book-binding apparatus 2A during a period of carriage error time; the following will describe an example of operation upon occurrence of a carriage error in the book-binding apparatus 2A equipped with the paper-sheet-loading device 1A with reference to the drawings.

When a carriage error occurs such as the booklets 100C etc. are jammed between the temporary reserve portion 60*a* and the first discharged paper carriage path 10 by the delivering operation of the booklets 100C etc from the binder unit 6 to the discharge-processing portion 7 as shown in FIG. 26, the paper sheet detection sensor 63 will not detect the passage of the read end of the booklets 100C etc.

When having found such a carriage error of the booklets 100C etc. based on the output of the paper sheet detection sensor 63, the control portion 90 controls the carriage path movement motor 94*c* to drive the first discharged paper carriage path 10 rotationally so that the first discharged paper carriage path 10 may swing around the first rotational pivot 73*a* as an axis so as to move to the paper sheet discharge position.

In a condition where the booklets 100C etc. are jammed due to a carriage error between the temporary reserve portion 60*a* and the first discharged paper carriage path 10, by the moving of the first discharged paper carriage path 10 from the paper sheet reception position to the paper sheet discharge portion, a load will be applied to the accessory guide member 72 resisting against the movement to the paper sheet discharge position by the accessory guide member 72 being pressed by the jammed booklets 100C etc.

Accordingly, the accessory guide member 72 remains at the paper sheet reception position while swinging around the second rotational pivot 72*a* as an axis accompanied with the movement of the first discharged paper carriage path 10 to the paper sheet discharge position, thus retreating and opening with respect to the main guide member 71 as shown in FIG. 27.

If the accessory guide member 72 remains at the paper sheet reception position in a condition where the main guide member 71 has moved to the paper sheet discharge position, a work space is secured below the temporary reserve portion 60*a* in which the booklets 100C etc. caught in a carriage error are pulled out in the carriage direction and removed.

Therefore, by indicating the occurrence of a carriage error and the guidance for a removal procedure etc. on an operation portion (not shown), the operator etc. can open the door 22*a* etc. to easily remove the booklets 100C etc. caught in the carriage error.

In such a manner, in removal operation of the booklets 100C etc. upon occurrence of a carriage error, an operation to open the guide member manually is unnecessary so that the manipulation by the operator etc. can be simplified, thus improving operability.

INDUSTRIAL APPLICABILITY

The present invention is applied to a book-binding apparatus which is connected to a copy machine etc. in use.

The invention claimed is:

1. A paper-sheet-loading device comprising:

a tray that has a loading face on which a bound booklet or unbound paper sheets or the like are loaded;

an elevation unit for moving the tray up and down along a direction in which the booklet or the paper sheets or the like are loaded;

an outlet that has an opening along the elevation direction of the tray in a front side of a body of the device;

a tray guide member that slidably supports the tray between a loading position where the booklet or paper sheets or the like are loaded and a take-out position where it is pulled out from the outlet and the loaded booklet or paper sheets or the like are taken out;

an auxiliary loading member that is exposed to a rear side of the tray pulled out to the take-out position and that has a shape after a shape of the loading face of the tray; and a loading guide face having a guide groove formed along the elevation direction of the tray, wherein the tray is provided with:

a fall prevention member that projects toward a direction of the loading guide face to enter the guide groove and moves along the guide groove accompanied with the elevation of the tray, the fall prevention member being provided on a side of a lower end of the loading face inclined in a direction in which its side on which a binding part which binds the loaded booklet is mounted goes down; and a retreating unit for allowing the fall prevention member to retreat from the guide groove by an operation to pulling out the tray from the loading position to the take-out position, and for placing back the fall prevention member into the guide groove by an operation to return the tray from the take-out position to the loading position.

2. The paper-sheet-loading device according to claim 1, wherein a guiding portion is provided which is formed on the tray and guides the booklet or paper sheets or the like loaded on the auxiliary loading member onto the loading face of the tray by an operation to return the tray from the take-out position to the loading position.

3. The paper-sheet-loading device according to claim 1, wherein the fall prevention member is mounted on the tray in such a manner that it can rise and set freely;

the retreating unit is configured of an urging unit that urges the fall prevention member in a projecting direction thereof;

by the operation to pull out the tray from the loading position to the take-out position, the fall prevention member retreats from the guide groove against the urging unit and also is urged by the urging unit to come in sliding contact with the loading guide face; and when the fall prevention member is disposed to a position where it faces the loading guide face accompanied with the operation to return the tray from the take-out position to the loading position, the fall prevention member is urged by the urging unit to come in sliding contact with the loading guide face and when the fall prevention member is disposed to a position where it faces the guide groove, the fall prevention member is urged by the urging unit to come back into the guide groove.

4. A book-binding apparatus that produces a booklet by binding a plurality of paper sheets with a binding part, the apparatus comprising:

a binding device for binding one side of a bundle of the paper sheets by the binding part to produce the booklet;

a paper discharge device for discharging the booklet bound by the binding device or the unbound paper sheets or the like through a discharge portion;

a tray having a loading face on which the booklet or the paper sheets or the like discharged through the discharge portion are loaded;

an elevation unit for moving the tray up and down along a direction in which the booklet or the paper sheets or the like are loaded;

an outlet that has an opening along the elevation direction of the tray in a front face of a body of the apparatus;

a tray guide member that slidably supports the tray between a loading position where the booklet or paper sheets or the like are loaded and a take-out position where it is pulled out from the outlet and the loaded booklet or paper sheets or the like are taken out; and an auxiliary loading member that is exposed to a rear side of the tray pulled out to the take-out position and that has a shape after a shape of the loading face of the tray; and a loading guide face having a guide groove formed along the elevation direction of the tray, wherein the tray is provided with:

a fall prevention member that projects toward a direction of the loading guide face to enter the guide groove and moves along the guide groove accompanied with the elevation of the tray, the fall prevention member being provided on a side of a lower end of the loading face inclined in a direction in which its side on which a binding part which binds the loaded booklet is mounted goes down; and a retreating unit for allowing the fall prevention member to retreat from the guide groove by an operation to pulling out the tray from the loading position to the take-out position, and for placing back the fall prevention member into the guide groove by an operation to return the tray from the take-out position to the loading position.

* * * * *